US008844079B2

(12) United States Patent
Skinner et al.

(10) Patent No.: US 8,844,079 B2
(45) Date of Patent: Sep. 30, 2014

(54) PRESSURE CONTROL FOR A HOSPITAL BED

(75) Inventors: Andrew F. Skinner, Batesville, IN (US); David Lokhorst, Victoria (CA); Richard B. Stacy, Daniel Island, SC (US); John A. Bobey, Daniel Island, SC (US); Stephen L. Douglas, Batesville, IN (US); Daniel K. Stevens, Summerville, SC (US)

(73) Assignee: Hill-Rom Services, Inc., Batesville, IN (US)

( * ) Notice: Subject to any disclaimer, the term of this patent is extended or adjusted under 35 U.S.C. 154(b) by 1175 days.

(21) Appl. No.: 11/994,477

(22) PCT Filed: Jul. 7, 2006

(86) PCT No.: PCT/US2006/026787

§ 371 (c)(1),
(2), (4) Date: Aug. 6, 2008

(87) PCT Pub. No.: WO2007/008830

PCT Pub. Date: Jan. 18, 2007

(65) Prior Publication Data

US 2009/0144909 A1 Jun. 11, 2009

Related U.S. Application Data

(60) Provisional application No. 60/697,748, filed on Jul. 8, 2005.

(51) Int. Cl.
*A61G 7/057* (2006.01)

(52) U.S. Cl.
CPC ..... *A61G 7/05776* (2013.01); *A61G 2203/34* (2013.01)
USPC ..... 5/710; 5/713; 5/690; 5/600

(58) Field of Classification Search
USPC ..... 5/600, 690, 713, 710
See application file for complete search history.

(56) References Cited

U.S. PATENT DOCUMENTS

| | | | |
|---|---|---|---|
| 779,576 | A | 1/1905 | Berryman |
| 3,303,518 | A | 2/1967 | Ingram |

(Continued)

FOREIGN PATENT DOCUMENTS

| | | | |
|---|---|---|---|
| CA | 2 393 880 | A1 | 1/2004 |
| DE | 103 16 162 | A1 | 10/2004 |

(Continued)

OTHER PUBLICATIONS

International Search Report and Written Opinion for PCT/US06/26787, dated Mar. 6, 2008 (8 pages).

(Continued)

*Primary Examiner* — William Kelleher
(74) *Attorney, Agent, or Firm* — Barnes & Thornburg LLP

(57) ABSTRACT

A patient support including a pressure adjustable mattress system. The pressure adjustable mattress system includes a support surface and a controller to control the pressure of the support surface.

30 Claims, 18 Drawing Sheets

(56) References Cited

U.S. PATENT DOCUMENTS

| | | | | |
|---|---|---|---|---|
| 3,772,717 | A | 11/1973 | Yuen et al. | |
| 3,978,530 | A | 9/1976 | Amarantos | |
| 4,120,061 | A * | 10/1978 | Clark | 5/710 |
| 4,477,935 | A | 10/1984 | Griffin | |
| 4,483,029 | A | 11/1984 | Paul | |
| 4,525,885 | A | 7/1985 | Hunt et al. | |
| 4,527,298 | A | 7/1985 | Moulton | |
| 4,541,135 | A | 9/1985 | Karpov | |
| 4,542,547 | A | 9/1985 | Sato | |
| 4,637,083 | A | 1/1987 | Goodwin | |
| 4,638,519 | A | 1/1987 | Hess | |
| 4,797,962 | A | 1/1989 | Goode | |
| 4,825,486 | A | 5/1989 | Kimura et al. | |
| 4,839,512 | A | 6/1989 | Speck | |
| 4,934,468 | A | 6/1990 | Koerber, Sr. et al. | |
| 4,944,060 | A | 7/1990 | Peery et al. | |
| 4,951,335 | A | 8/1990 | Eady | |
| 4,953,244 | A | 9/1990 | Koerber, Sr. et al. | |
| 4,993,920 | A | 2/1991 | Harkleroad et al. | |
| 5,020,176 | A * | 6/1991 | Dotson | 5/710 |
| 5,029,352 | A | 7/1991 | Hargest et al. | |
| 5,036,559 | A | 8/1991 | Hargest | |
| 5,060,174 | A | 10/1991 | Gross | |
| 5,067,189 | A | 11/1991 | Weedling et al. | |
| 5,117,518 | A | 6/1992 | Schild | |
| 5,121,512 | A | 6/1992 | Kaufmann | |
| 5,140,309 | A | 8/1992 | Gusakov | |
| 5,163,196 | A | 11/1992 | Graebe et al. | |
| 5,168,589 | A | 12/1992 | Stroh et al. | |
| 5,184,122 | A | 2/1993 | Decious et al. | |
| 5,267,364 | A | 12/1993 | Volk | |
| 5,269,030 | A | 12/1993 | Pahno et al. | |
| 5,276,432 | A | 1/1994 | Travis | |
| 5,325,551 | A | 7/1994 | Tappel et al. | |
| 5,364,162 | A | 11/1994 | Bar et al. | |
| 5,483,709 | A | 1/1996 | Foster et al. | |
| 5,483,711 | A | 1/1996 | Hargest et al. | |
| 5,539,942 | A | 7/1996 | Melou | |
| 5,542,136 | A | 8/1996 | Tappel | |
| 5,561,873 | A | 10/1996 | Weedling | |
| 5,561,875 | A | 10/1996 | Graebe | |
| 5,564,142 | A | 10/1996 | Liu | |
| 5,586,346 | A | 12/1996 | Stacy et al. | |
| 5,596,781 | A | 1/1997 | Graebe | |
| 5,611,096 | A * | 3/1997 | Bartlett et al. | 5/617 |
| 5,623,736 | A | 4/1997 | Soltani et al. | |
| 5,634,225 | A | 6/1997 | Miller, Sr. et al. | |
| D386,035 | S | 11/1997 | Matsler et al. | |
| 5,684,460 | A | 11/1997 | Scanlon | |
| 5,689,845 | A | 11/1997 | Sobieralski | |
| 5,692,256 | A | 12/1997 | Kramer et al. | |
| 5,699,570 | A | 12/1997 | Wilkinson et al. | |
| 5,731,062 | A | 3/1998 | Kim et al. | |
| 5,785,716 | A | 7/1998 | Bayron et al. | |
| 5,787,531 | A | 8/1998 | Pepe | |
| 5,794,288 | A | 8/1998 | Soltani et al. | |
| 5,815,864 | A | 10/1998 | Sloop | |
| 5,815,865 | A | 10/1998 | Washburn et al. | |
| 5,829,081 | A | 11/1998 | Pearce | |
| 5,845,352 | A | 12/1998 | Matsler et al. | |
| 5,873,137 | A * | 2/1999 | Yavets-Chen | 5/713 |
| D407,353 | S | 3/1999 | Bar et al. | |
| D408,767 | S | 4/1999 | Bar et al. | |
| 5,917,180 | A | 6/1999 | Reimer et al. | |
| D412,685 | S | 8/1999 | Bar et al. | |
| D413,085 | S | 8/1999 | Bar et al. | |
| D413,841 | S | 9/1999 | Bar et al. | |
| 5,954,402 | A | 9/1999 | McInturff | |
| D415,567 | S | 10/1999 | Bar | |
| D415,834 | S | 10/1999 | Bar | |
| 5,966,762 | A | 10/1999 | Wu | |
| 5,970,789 | A | 10/1999 | Meyer et al. | |
| D416,326 | S | 11/1999 | Bar | |
| 5,984,418 | A | 11/1999 | McInturff | |
| 5,991,949 | A | 11/1999 | Miller, Sr. et al. | |
| 6,014,346 | A | 1/2000 | Malone | |
| 6,095,611 | A | 8/2000 | Bar et al. | |
| 6,145,142 | A | 11/2000 | Rechin et al. | |
| 6,154,907 | A | 12/2000 | Cinquin | |
| 6,165,142 | A | 12/2000 | Bar | |
| D439,098 | S | 3/2001 | Matsler et al. | |
| 6,212,718 | B1 | 4/2001 | Stolpmann et al. | |
| 6,272,707 | B1 | 8/2001 | Robrecht et al. | |
| 6,280,392 | B1 | 8/2001 | Yoshimi et al. | |
| 6,295,675 | B1 | 10/2001 | Ellis et al. | |
| D463,701 | S | 10/2002 | Gorcherding et al. | |
| 6,474,743 | B1 | 11/2002 | Harker et al. | |
| 6,487,739 | B1 | 12/2002 | Harker | |
| 6,560,804 | B2 * | 5/2003 | Wise et al. | 5/713 |
| 6,564,410 | B2 | 5/2003 | Graebe et al. | |
| 6,593,588 | B1 | 7/2003 | Reimer | |
| 6,623,080 | B2 | 9/2003 | Clapper | |
| 6,646,556 | B1 | 11/2003 | Smith et al. | |
| 6,687,936 | B2 | 2/2004 | Graebe et al. | |
| 6,687,937 | B2 | 2/2004 | Harker | |
| 6,701,556 | B2 | 3/2004 | Romano et al. | |
| 6,782,574 | B2 | 8/2004 | Totton et al. | |
| 6,848,135 | B1 | 2/2005 | Kohlman | |
| 6,877,178 | B2 * | 4/2005 | Chapman et al. | 5/713 |
| 6,892,405 | B1 * | 5/2005 | Dimitriu et al. | 5/615 |
| 6,987,232 | B2 | 1/2006 | Smith et al. | |
| 7,145,461 | B2 | 12/2006 | Lehrman et al. | |
| 7,253,366 | B2 | 8/2007 | Bhai | |
| 2001/0011480 | A1 | 8/2001 | Reimer | |
| 2002/0066143 | A1 | 6/2002 | Graebe et al. | |
| 2003/0030319 | A1 | 2/2003 | Clapper | |
| 2003/0182728 | A1 * | 10/2003 | Chapman et al. | 5/713 |
| 2005/0172398 | A1 | 8/2005 | Smith et al. | |
| 2006/0152378 | A1 | 7/2006 | Lokhorst et al. | |

FOREIGN PATENT DOCUMENTS

| | | | |
|---|---|---|---|
| DE | 103 33 742 | A1 | 2/2005 |
| EP | 853 918 | A2 | 7/1998 |
| FR | 2 814 062 | | 3/2002 |
| GB | 159299 | | 2/1921 |
| GB | 2 092 439 | A | 8/1982 |
| GB | 2 199 803 | A | 7/1988 |
| WO | WO 94/09686 | | 5/1984 |
| WO | WO 95/31920 | | 11/1995 |
| WO | WO 96/33641 | | 10/1996 |
| WO | WO 2004/006768 | | 1/2004 |
| WO | WO 2005/013878 | | 2/2005 |

OTHER PUBLICATIONS

A Hill-Rom Solution, Acucair Continuous Airflow System, Hill-Rom Company, Inc., Batesville, IN, 1998.

Hill-Rom PrimeAire® ARS Pressure Relief Mattress, Hill-Rom Company, Inc., Batesville, IN, 2004.

Gaymar Soft-Care Plus© Companion System, Gaymar Industries, Inc., 1994.

First Step, Mattress Replacement System, KCI, San Antonio, TX, 1991.

Impression Pressure Relief Therapy, KCI, date unknown.

Lumex Akro Tech 4000, Lumex, date unknown.

microAIRO 1000, GSI Medical Systems, Carmel, NY, 1989.

Pro 2000 MRS, Pneu-Care Series, Cardio Systems, Dallas, TX, date unknown.

Prodigy Mattress Crown Therapeutics, Inc., date unknown.

Roho Dry Flotation Isolette see roho.com/medical/isolette.jsp., date unknown.

Roho series Crown Therapeutic, Inc., see woundheal.com, date unknown.

Tytex Group AirX #D Spacer Fabric see tytex.cms. digitalis.dk, dte unknown.

Renaissance™ Therapeutic Mattress Replacement System, Pegasus Airwave, Inc., date unknown.

Air Flow 5000 Mattress Replacement System, Atlantis Medical, Milltown, NJ, date unknown.

(56) References Cited

OTHER PUBLICATIONS

Apropros, CRS-8500, National Patient Care Systems, date unknown.

Asap II Therapy System, DynaMedics Corporation, London, ON, Canada Mar. 1995.

Bazooka, Innovative Medical System, Manchester, NH, 1995.

DFS® Homecare Advanced Dynamic Flota ion System, HNE Healthcare, Manalapan, NJ, date unknown.

Economic Relief, Bio Therapy © Plus, Sunrise Medical Bio Clinic, Ontario, CA, date unknown.

* cited by examiner

PRESSURE CONTROL FOR A HOSPITAL BED

CROSS-REFERENCE TO RELATED APPLICATIONS

This application is the U.S. national phase of PCT/US2006/026787 filed Jul. 7, 2006. PCT/US2006/026787 claims priority to U.S. Provisional Patent Application No. 60/697,748 filed Jul. 8, 2005, entitled PRESSURE CONTROL FOR A HOSPITAL BED. The entire disclosures of both of PCT/US2006/026787 and U.S. Ser. No. 60/697,748 are hereby incorporated by reference. The present application is related to U.S. patent application Ser. No. 11/119,980, entitled PRESSURE RELIEF SURFACE, and U.S. patent application Ser. No. 11/119,991, entitled PATIENT SUPPORT HAVING REAL TIME PRESSURE CONTROL, and U.S. patent application Ser. No. 11/119,635, entitled LACK OF PATIENT MOVEMENT MONITOR AND METHOD, and U.S. patent application Ser. No. 11/120,080, entitled PATIENT SUPPORT, all of which were filed on May 2, 2004, all of which are assigned to the assignee of the present invention, and all of which are incorporated herein by this reference.

The present application is also related to U.S. Provisional Patent Application Ser. No. 60/636,252, entitled QUICK CONNECTOR FOR MULTIMEDIA, filed Dec. 15, 2004, which is assigned to the assignee of the present invention and incorporated herein by this reference.

The present application is also related to U.S. Provisional Patent Application Ser. No. 60/697,708, entitled CONTROL UNIT FOR PATIENT SUPPORT and U.S. Provisional Patent Application Ser. No. 60/697,723, entitled PRESSURE RELIEF SUPPORT SURFACE, which were filed on Jul. 8, 2005, are assigned to the assignee of the present invention, and are incorporated herein by this reference.

In addition, PCT patent application, entitled BODY SUPPORT APPARATUS HAVING AUTOMATIC PRESSURE CONTROL AND RELATED METHODS, of Lokhorst et al., PCT Publication No. WO2005104904, U.S. patent application Ser. No. 11/568,511, now U.S. Pat. No. 7,685,658, filed on May 2, 2005, is incorporated by reference herein in its entirety.

BACKGROUND

The present invention relates to a device for supporting a patient, such as a mattress. In particular, the present invention relates to patient supports appropriate for use in hospitals, acute care facilities, and other patient care environments. Further, the present invention relates to pressure relief support surfaces and support surfaces that are configured to accommodate and operate with a variety of sizes and styles of beds, bed frames, and patient types.

Known patient supports are disclosed in, for example, U.S. Pat. No. 5,630,238 to Weismiller et al., U.S. Pat. No. 5,715,548 to Weismiller et al., U.S. Pat. No. 6,076,208 to Heimbrock et al., U.S. Pat. No. 6,240,584 to Perez et al., U.S. Pat. No. 6,320,510 to Menkedick et al., U.S. Pat. No. 6,378,152 to Washburn et al., and U.S. Pat. No. 6,499,167 to Ellis et al., all of which are owned by the assignee of the present invention and all of which are incorporated herein by this reference.

SUMMARY

The present invention provides an apparatus and method for adjusting the interface pressure between a support surface and a person or patient on the surface once an optimum or minimized interface pressure between a support surface and a person or patient on the surface has been determined.

According to another aspect of the present invention, there is provided a pressure adjustable mattress system to support a patient. The system includes a pressure adjustable mattress, a controller coupled to the pressure adjustable mattress to control the mattress in an automatic pressure relief mode and an adjustable mode, and a user interface, coupled to the controller, including a selectable input to enable a user to control the pressure adjustable mattress in the automatic mode or the user adjustable mode.

Also there is provided a method for adjusting the pressure in a pressure adjustable mattress system including a controller, a user interface coupled to the controller to receive a user input, and a mattress to support a person. The method includes the steps of automatically determining a first pressure for the pressure adjustable mattress when the mattress is supporting the person and adjusting the first pressure to a second pressure, different than the first pressure, in response to the controller receiving the user input.

BRIEF DESCRIPTION OF THE DRAWINGS

Aspects of the present invention are more particularly described below with reference to the following figures, which illustrate an exemplary embodiment of the present invention.

DETAILED DESCRIPTION

Figure 1:
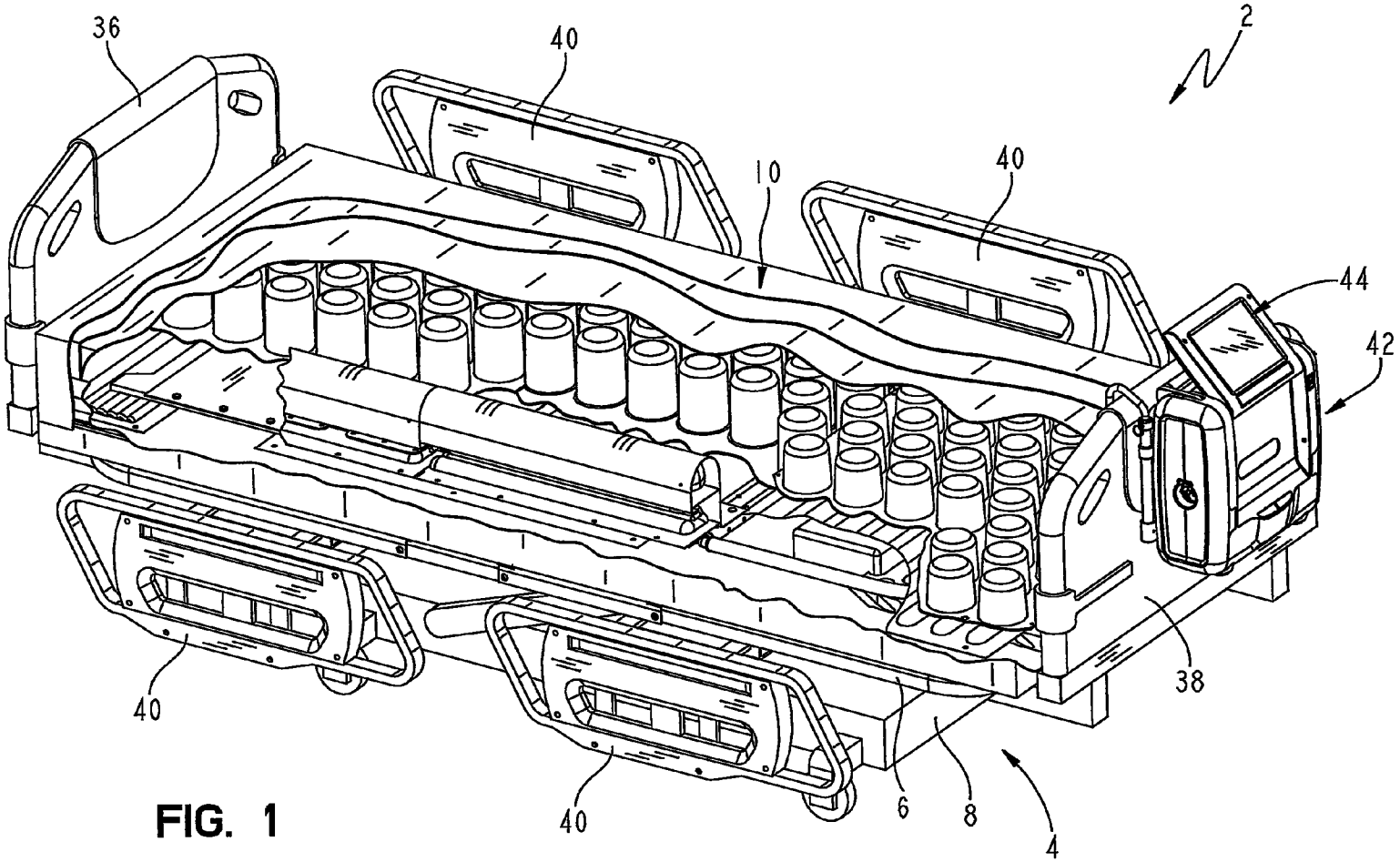
FIG. 1 is a perspective view of a patient support positioned on an exemplary hospital bed, with a portion of the patient support being cut away to show interior components of the patient support.

FIG. 1 shows an embodiment of a patient support 10 in accordance with the present invention. Patient support 10 is positioned on an exemplary bed 2. Bed 2, as illustrated, is a hospital bed for use in a hospital or other health care facility, including a frame 4, a headboard 36, a footboard 38, and a plurality of siderails 40.

Frame 4 of the exemplary bed 2 generally includes a deck 6 supported by a base 8. Deck 6 includes one or more deck sections (not shown), some or all of which may be articulating sections, i.e., pivotable with respect to base 8. In general, patient support 10 is configured to be supported by deck 6.

Patient support 10 has an associated control unit 42, which controls inflation and deflation of certain internal components of patient support 10. Control unit 42 includes a user interface 44, which enables caregivers and service providers to configure patient support 10 according to the needs of a particular patient. For example, support characteristics of patient support 10 may be adjusted according to the size, weight, position, or activity of the patient. Patient support 10 can accommodate a patient of any size, weight, height or width. It is also within the scope of the present invention to accommodate bariatric patients of up to 1000 pounds or more. To accommodate patients of varied sizes, the patient support may include a width of up to 50 inches or more.

User interface 44 also enables patient support 10 to be adapted to different bed configurations. For example, deck 6 may be a flat deck or a step deck. A caregiver may select the appropriate deck configuration via user interface 44. An exemplary control unit 42 and user interface 44 are described in detail in U.S. Provisional Patent Application Ser. No. 60/697,708, entitled CONTROL UNIT FOR PATIENT SUPPORT, filed on Jul. 8, 2005, assigned to the assignee of the present invention, and incorporated herein by reference.

Figure 2:
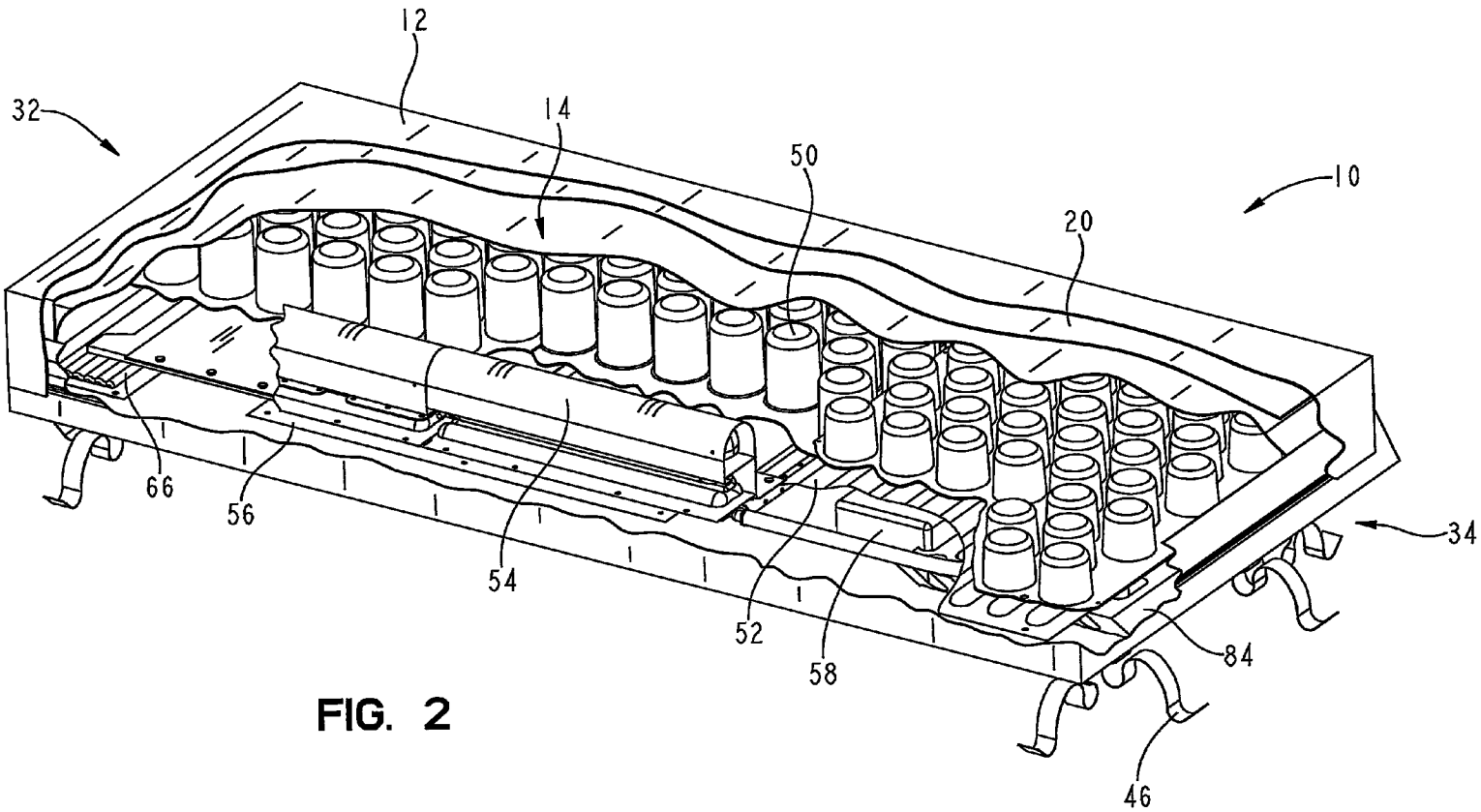
FIG. 2 is a perspective view of a patient support, with a portion being cut away to show interior components of the patient support.

Referring now to FIG. 2, patient support 10 has a head end 32 configured to support a patient's head and upper body region, and a foot end 34 configured to support a patient's feet and lower body region. Patient support 10 includes a cover 12 which defines an interior region 14. In the illustrated embodiment, interior region 14 includes a first layer 20, a second layer 50, and a third layer 52.

As shown in FIG. 2, first layer 20 includes a three-dimensional material, second layer 50 includes a plurality of vertically-oriented air bladders located underneath the first layer, and third layer 52 includes a plurality of pressure sensors located underneath the vertical bladders of second layer 50, as more particularly described below. The vertically oriented air bladders can be cylindrical in shape where the height of a bladder is greater than the width of the bladder. Bladders of other shapes are also possible, including upstanding cylindrical bladders where the width is greater than the height.

Also located within interior region 14 are a plurality of bolsters 54, a plurality of filler portions 56, and a pneumatic valve control box 58. A fire-resistant material (not shown) may also be included in the interior region 14.

Patient support 10 may be coupled to deck 6 by one or more couplers 46. Illustratively, couplers are conventional woven straps including a Velcro® brand or similar fastener. However, it is understood that other suitable couplers may be used.

Figure 3:
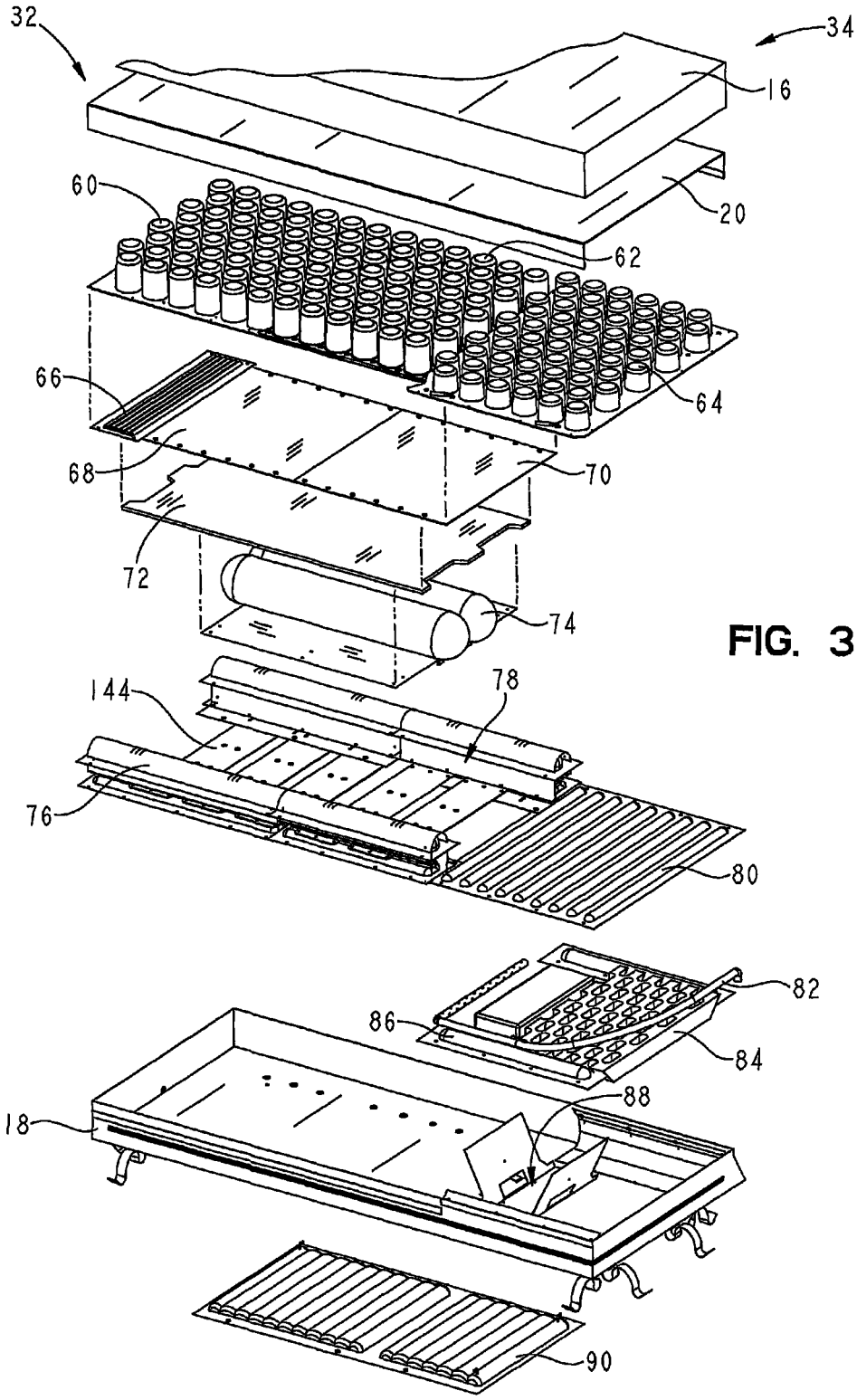
FIG. 3 is an exploded view of components of a patient support.

Components of one embodiment of a patient support in accordance with the present invention are shown in exploded view in FIG. 3. This embodiment of patient support 10 includes a top cover portion 16 and a bottom cover portion 18. Top cover portion 16 and bottom cover portion 18 couple together by conventional means (such as zipper, Velcro®, snaps, buttons, or other suitable faster) to form cover 12, which defines interior region 14. While a plurality of layers and/or components are illustrated within interior region 14, it will be understood by those of skill in the art that the present invention does not necessarily require all of the illustrated components.

A first support layer 20 is located below top cover portion 16 in interior region 14. Support layer includes one or more materials, structures, or fabrics suitable for supporting a patient, such as foam, inflatable bladders, or three-dimensional material. Suitable three-dimensional materials include Spacenet® and/or Tytex™-brand or similar materials.

A second support layer including one or more bladder assemblies, is located underneath the first support layer 20. The illustrated embodiment of the second support layer includes first, second and third bladder assemblies, namely, a head section bladder assembly 60, a seat section bladder assembly 62, and a foot section bladder assembly 64. However, it will be understood by those skilled in the art that other embodiments include only one bladder assembly extending from head end 32 to foot end 34, or other arrangements of multiple bladder assemblies, for example, including an additional thigh section bladder assembly.

A pressure-sensing layer illustratively including first and second sensor pads, namely a head sensor pad 68 and a seat sensor pad 70, is positioned underneath bladder assemblies 60, 62, 64. Head sensor pad 68 is generally aligned underneath head section bladder assembly 60, and seat sensor pad 70 is generally aligned underneath seat section bladder assembly 62, as shown. It will be understood by those skilled in the art that other embodiments include a single sensor pad or additional sensor pads, for example, located underneath foot section bladder assembly 64, and/or different alignments of the sensor pads. A pressure valve and transducer can be coupled to the foot section bladder assembly 64 through a fluid line to control the amount of fluid supplied to the assembly 64 as well as to measure the pressure therein.

In the illustrated embodiment, a turn-assist cushion 74 is located below sensor pads 68, 70. The exemplary turn-assist cushion 74 shown in FIG. 3 includes a pair of inflatable bladders. Suitable turn-assist cushions are disclosed in, for example, U.S. Pat. No. 6,499,167 to Ellis, et al., which patent is owned by the assignee of the present invention and incorporated herein by this reference. One of ordinary skill in the art will readily appreciate that turn-assist cushions 74 are not necessarily a required element of the present invention.

A plurality of other support components 66, 72, 76, 78, 80, 84, 86, 90 are also provided in the illustrated embodiment of FIG. 3. One or more of these support components are provided to enable patient support 10 to be used in connection with a variety of different bed frames, in particular, a variety of bed frames having different deck configurations. One or more of these support components may be selectively added to or removed from patient support 10 in order to conform patient support 10 to a particular deck configuration, such as a step or recessed deck or a flat deck.

The support components illustrated in FIG. 3 are made of foam, inflatable bladders, three-dimensional material, other suitable support material, or a combination of these. For example, as illustrated, head filler 66 includes a plurality of foam ribs extending transversely across patient support 10. Filler portion 72 includes a foam layer positioned substantially underneath the sensor pads 68, 70 and extending transversely across the patient support 10.

Head bolster assembly 76 and seat bolster assembly 78 each include longitudinally-oriented inflatable bladders spaced apart by coupler plates 144.

As illustrated, first foot filler portion 80 includes a plurality of inflatable bladders extending transversely across patient support 10, and second foot filler portion 84 includes a foam member, illustratively with portions cut out to allow for retractability or for other reasons. Deck filler portion 90 includes a plurality of transversely-extending inflatable bladders. As illustrated, deck filler portion 90 includes two bladder sections, and is located outside of cover 12. However, one of ordinary skill in the art will recognize that deck filler portion 90 may include one or more bladder regions, or may be located within interior region 14, without departing from the scope of the present invention.

Also provided in the illustrated embodiment are a pneumatic valve box 58 and an air supply tube assembly 82. Receptacle 88 is sized to house pneumatic valve box 58. In the illustrated embodiment, receptacle 88 is coupled to bottom cover portion 18.

Figure 4A:
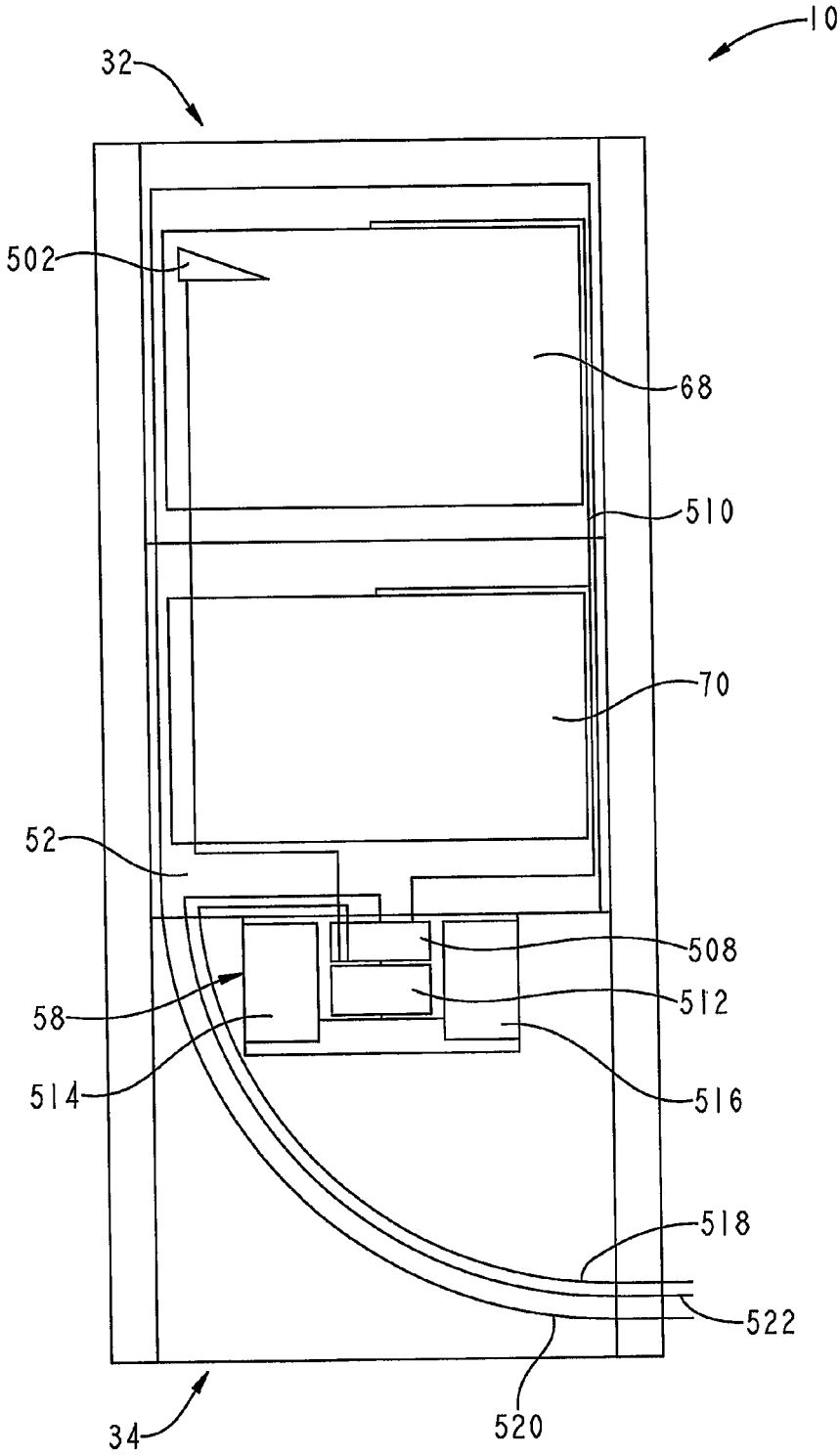
FIGS. 4A and 4B are a simplified schematic diagram of the control system and the mattress assembly of the present invention.
Figure 4B:
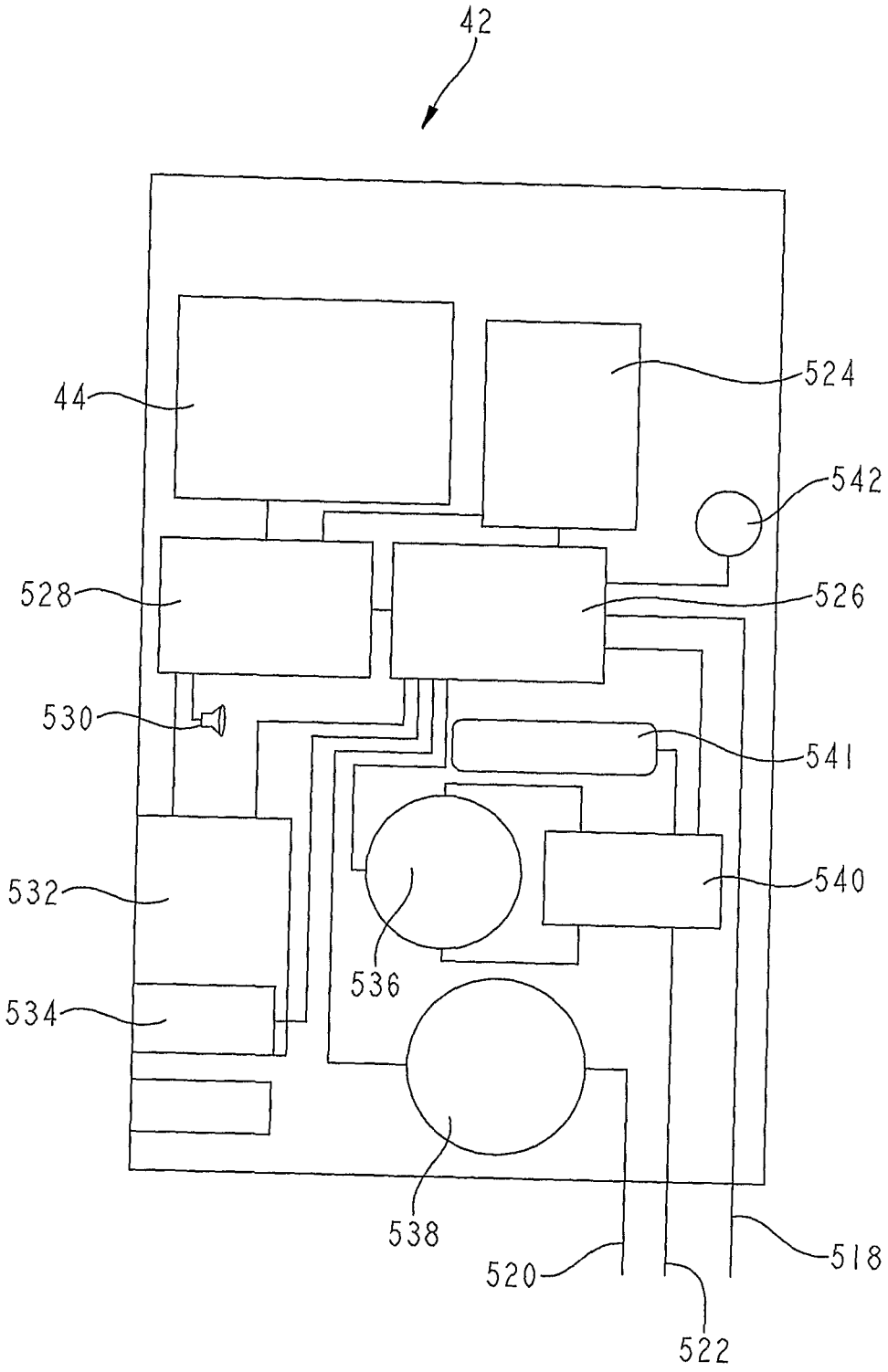

FIGS. 4A and 4B are a simplified schematic diagram of a control system and the patient support or mattress 10 of the present invention. FIG. 4A illustrates the patient support 10 including the various components of patient support 10 whereas FIG. 4B illustrates the control unit 42 and the various components. The patient support 10 includes the sensor pad 52 which is coupled to the pneumatic valve control box 58 as previously described. The sensor pad 52 includes a head sensor pad 68 and a seat sensor pad 70. The head sensor pad 68 is located at the head end 32 of the mattress 10. The seat sensor pad 70 is located at a middle portion of the mattress 10 which is located between the head end 32 and a location of the pneumatic valve control box 58. The seat sensor pad 70 is located such that a patient laying upon the mattress 10 may have its middle portion or seat portion located thereon when in a reclined state. In addition, when the head end 32 of the mattress 10 is elevated, the seat portion of the patient is located upon the seat sensor pad 70. As previously described with respect to FIG. 3, the head sensor pad 68 is located beneath the head section bladder assembly 60 and the seat sensor pad 70 is located beneath the seat section bladder assembly 62. Each one of the sensors of the head sensor pad 68 or the seat sensor pad 70 is located beneath one of the upstanding cylindrical bladders or cushions. A head angle sensor 502 is coupled to the control box 58 where signals received from the sensor 52 may provide head angle information and pressure adjustment information for pressure in the seat bladders 62.

The sensor pad 52 includes individual sensors, integrated electronics, and cabling to be described later herein in more detail. The sensor pad 52 is coupled through the associated cabling to the pneumatic control box 58. The pneumatic control box includes a multiplexer 508 coupled to the head sensor pad 68 and the seat sensor pad 70 through a signal and control line 510. The multiplexer board 508 is also coupled to an air control board 512 which is in turn coupled to a first valve block 514 and a second valve block 516. A communication/power line 518 is coupled to the control unit 42 of FIG. 4B. Likewise, a ventilation supply line 520 which provides for air flow through the patient support 10 for cooling as well as removing moisture from the patient is also coupled to the control unit 42 of FIG. 4B. An air pressure/vacuum supply line 522 is coupled to the control unit 42 as well.

The control unit 42 of FIG. 4B, also illustrated in FIG. 1, includes the display 44, which displays user interface screens, and a user interface input device 524 for inputting to the control unit 42 user selectable information, such as the selection of various functions or features of the present device. The selections made on the user interface input device 524 control the operation of the patient support 10, which can include selectable pressure control of various bladders within the mattress 10, control of the deck 6, for instance to put the bed 2 in a head elevated position, as well as displaying the current state of the mattress, deck position, and other features.

An algorithm control board 526 is coupled to the user interface input device 524. The algorithm control board 526 receives user generated input signals received through the input device 524 upon the selection of such functions by the user. The input device 524 can include a variety of input devices, such as pressure activated push buttons, a touch screen, as well as voice activated or other device selectable inputs. The algorithm control board 526 upon receipt of the various control signals through the user input device 524 controls not only the pressure regulation of the mattress 10 but also a variety of other devices which are incorporated into the control unit 42. For instance, the algorithm control board 526 is coupled to a display board 528 which sends signals to the display 44 to which it is coupled. The display board 528 is also connected to a speaker 530 which generates audible signals which might indicate the selection of various features at the input device 24. The algorithm control board 526 receives the required power from power supply 532 which includes an AC input module 534, typically coupled to a wall outlet within a hospital room.

The algorithm control board 526 is coupled to a compressor 536 and a blower 538. Both the compressor 536 and the blower 538 receive control signals generated by the algorithm control board 526. The compressor 536 is used to inflate the air bladders. The blower 538 is used for air circulation which is provided through the ventilation supply line 520 to the mattress 10. It is, however, possible that the compressor 536 may be used to both inflate the bladders and to circulate the air within the mattress 10. A pressure/vacuum switch valve 540 is coupled to the compressor 536 which is switched to provide for the application of air pressure or a vacuum to the mattress 10. A muffler 541 is coupled to the valve 540. In the pressure position, air pressure is applied to the mattress 10 to inflate the mattress for support of the patient. In the vacuum position, the valve 540 is used to apply a vacuum to the bladders therein such that the mattress may be placed in a collapsed state for moving to another location or to deflate bladders during turn assist. A CPR button 542 is coupled to the algorithm control board 526.

As illustrated, the algorithm control board 526, the compressor 536, the blower 538, and the user input device or user control module 524 are located externally to the mattress and are a part of the control unit 42 located on the footboard 38. The sensors and sensor pad 52, the pneumatic valve control box 58, and the air control board or microprocessor 512 for controlling the valves and the sensor pad system 52 are located within the mattress 10. It is within the present scope of the invention to locate some of these devices within different sections of the overall system, for instance, such that the algorithm control board 526 could be located within the mattress 10 or the air control board 512 could be located within the control unit 42.

Figure 5:
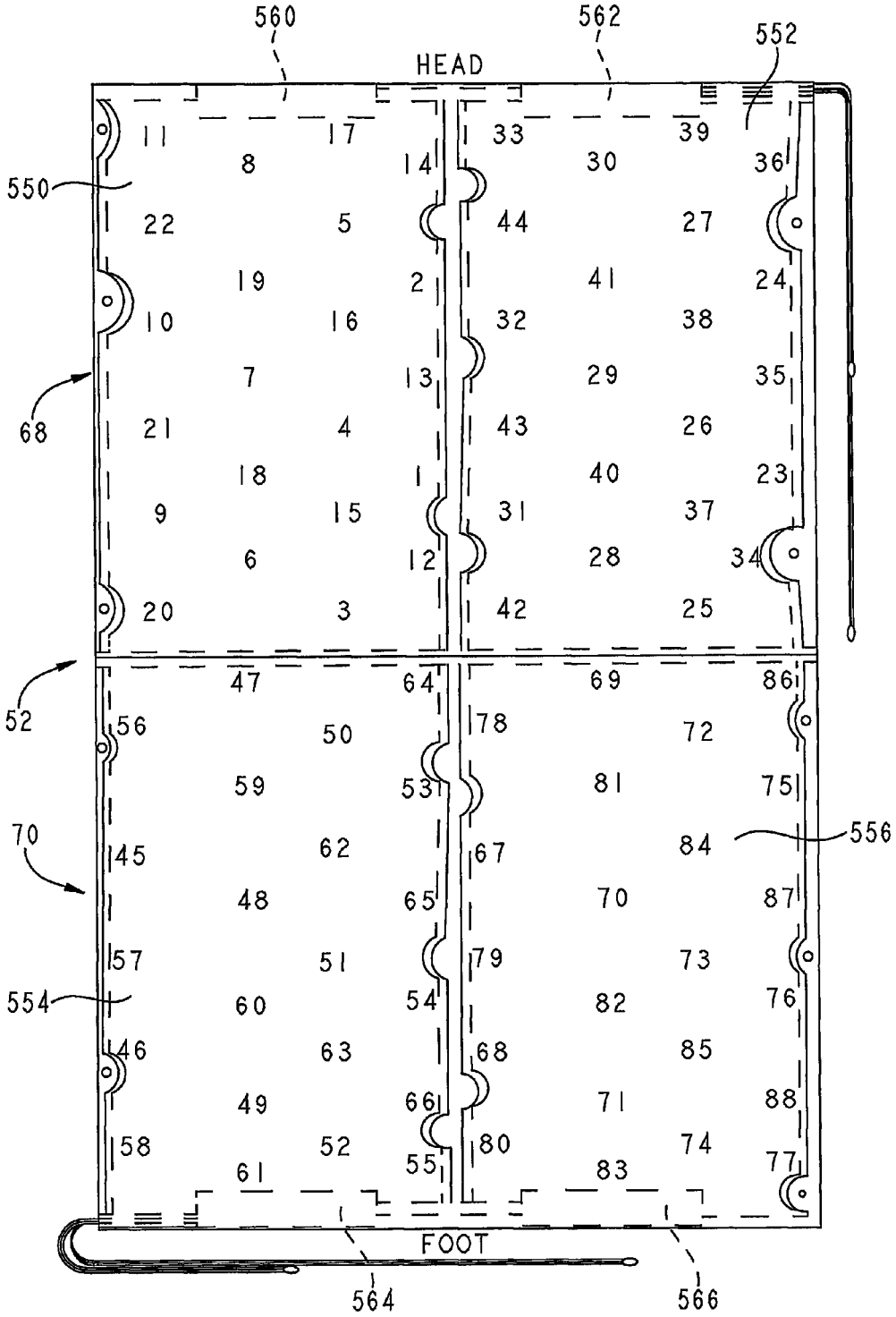
FIG. 5 illustrates a first and second sensor pad including a sequence of reading data from the sensors of the sensor pad.

FIG. 5 illustrates the sensor pad 52 including the head sensor pad 68 and the seat sensor pad 70. Each of the pads includes a plurality of sensors configured to provide a reflected wave energy signal is described in PCT Publication WO 2004/00678A1 having a publication date of 22 Jan. 2004, the disclosure of which is incorporated by reference herein. The sensor pads include fiber pairs which introduce wave energy, typically light, into a compressible medium such as foam. The light introduced to the foam is scattered in a manner dependent on the force applied to the surface of the foam. The reflected or scattered light energy is detected and converted to an electrical signal indicative of the force applied to the sensor. Both the head sensor pad 68 and seat sensor pad 70 each include 44 individual sensors spaced throughout. The location of each of individual pressure sensing elements is indicated by a number 1 through 88. The sensor pad 68 and the sensor pad 70 each include and can be considered as a collection of 44 independent interface pressure sensors. The areas between sensors are generally not sensitive to pressure. The signals or data generated by the sensors indicate a pressure distribution, the data being essentially a map of the interface pressure between the bottom of the bladder assembly and the deck or frame.

The head sensor pad 68 includes a first sensor group 550 and a second sensor group 552. The first sensor group 550 is located in an upper left quadrant of the sensor pad 52 whereas the second sensor group 552 is in an upper right quadrant of the sensor pad 52. Each of the individual sensor groups 550 and 552 include 22 sensors, the location of which is indicated and identified by a number. For instance, the first sensor group 550 includes sensors 1 through 22 and the second sensor group 552 includes sensors 23 through 44. The numerical order of the individual sensors indicates the sequence in which the information from each of these sensors is accessed by the multiplexer board 508.

The seat sensor pad 70 includes a third sensor group 554 and a fourth sensor group 556 configured to be substantially the same as the first sensor group 550 and the second sensor group 552 as previously described. Each of the sensor groups includes 22 sensors which have numbers indicating the sequence in which the signal information is accessed or derived therefrom.

Each of the sensor groups 550, 552, 554, and 556 include an optical system device 560, 562, 564, and 566 respectively. Each of these devices includes a cable for connection to the pneumatic valve control box 58. Since each of the first sensor group 550, 552, 554, and 556 are substantially identical in construction, the optical system device 560 will be described and its description will apply to the remaining optical system devices 562, 564 and 566.

The optical system device 560 is an opto-electronics interface board including software embedded on a micro controller integrated with an opto-board and the sensor pad itself. The embedded software of the microprocessor is typically referred to as "firmware". As described in PCT publication WO 2004/006768A1, each of the sensors includes fiber optic cable which is coupled to the opto-electric board. Two light emitting diodes supply light to each of the individual sensors and a single photo diode array reads the optical inputs of all 22 sensors within a sensor group. An erasable programmable read only memory and a serial interface driver for communication are included. The primary purpose of the optical system device is to acquire the information sensed by each of the individual sensors which result from the reflected light which has been passed through the fiber optic cable to the individual sensor. Algorithms within the embedded microprocessor are used to linearize the data sensed by the sensors. The sensor data and diagnostic data are made available to the multiplexer 508 through RS-232 ports. Data is transmitted though the network 578, which may be a controller area network (CAN) bus, to the algorithm control unit 526.

Figure 6:
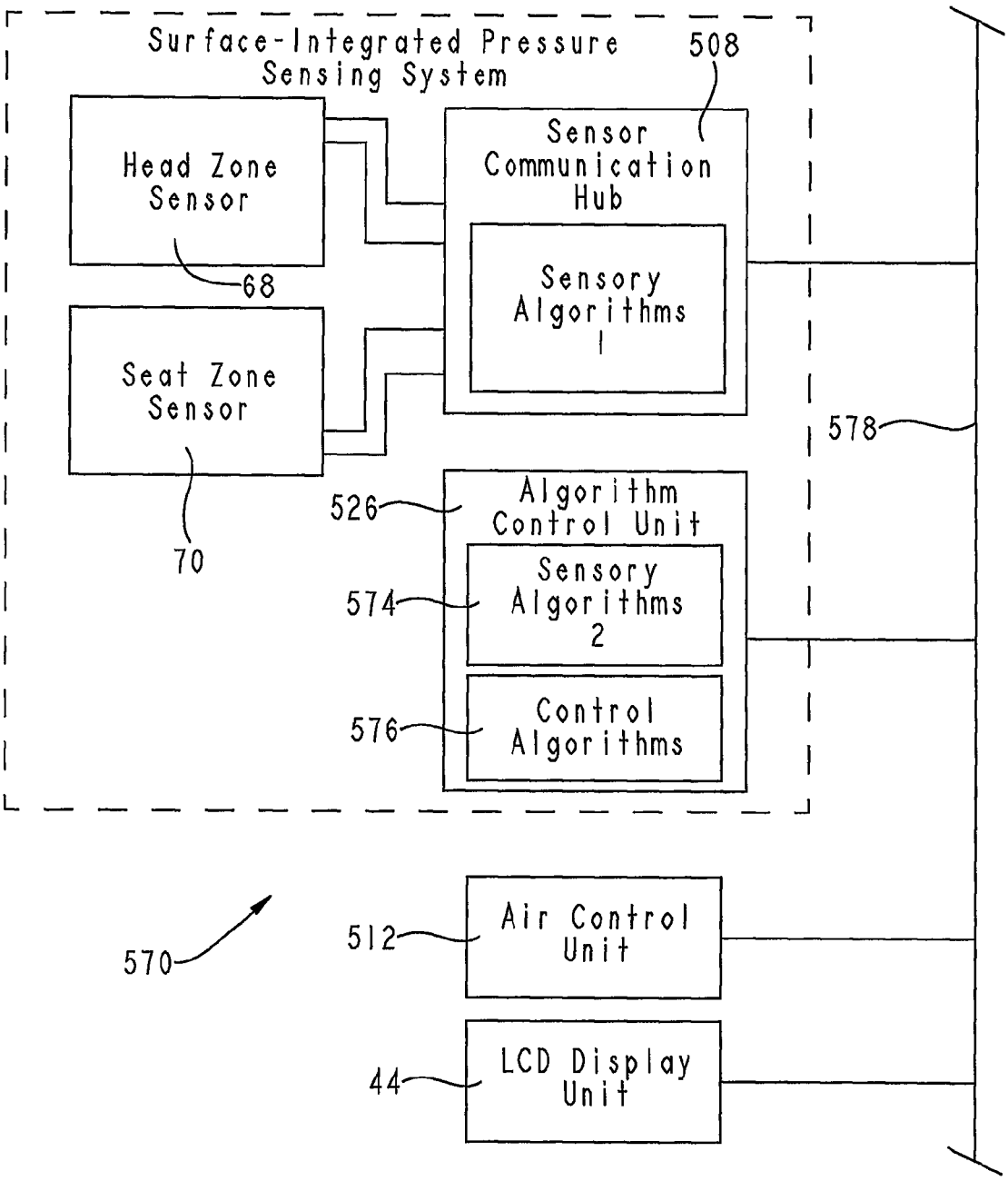
FIG. 6 illustrates a functional block diagram illustrating the head zone and seat zone sensors and other system components coupled to a communication network.

FIG. 6 illustrates an overall system architecture 570 of the present invention. As previously described, the multiplexer board 508, also known as a sensor communication hub, is coupled to the head zone sensor 68 and the seat zone sensor 70. The multiplexer 508 as well as the optical system devices includes a number of sensory algorithms to be described later herein. Also included in the system architecture 570 is the algorithm control unit 526 which includes a second set of sensory algorithms 574 and control algorithms 576. The output of the multiplexer 508 and the algorithm control unit 526 are coupled to a network 578 which is also coupled to the air control unit 512 and the LCD display unit 44. The network 578 includes interface hardware, also known as a communication hub. The network 578 acts as the communication bus for the various hardware, software, and firmware control devices.

As previously described, the multiplexer 508 includes the sensory algorithms 572. The algorithm control unit 526 also includes sensory algorithms which may include algorithms for providing pressure relief, for providing a motion metric, for providing weight estimation, and for providing information to a LCD module which includes a calculation of statistics model.

Figure 7:
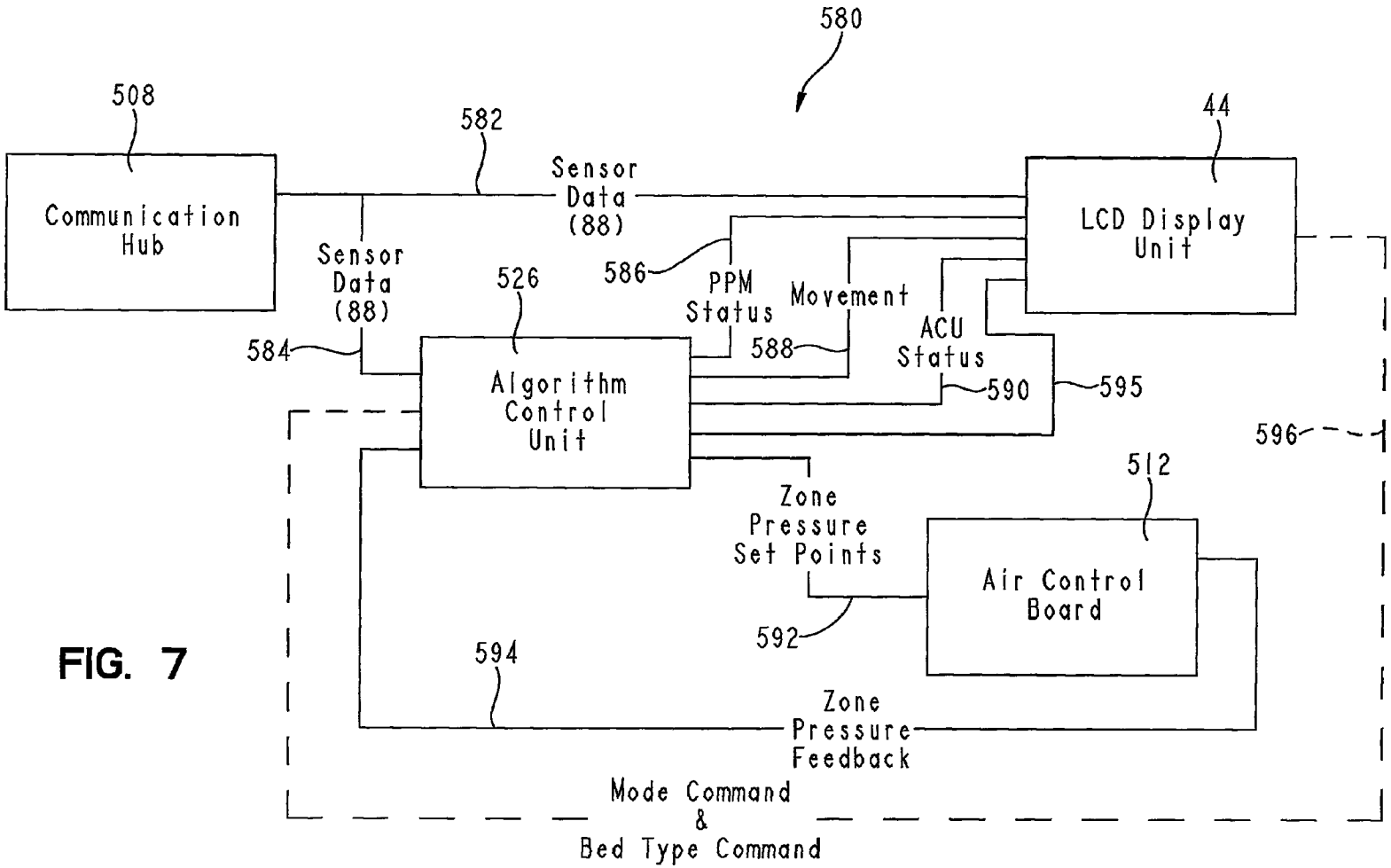
FIG. 7 illustrates a block diagram for a control system of the present invention including an algorithm control unit.

FIG. 7 illustrates a block diagram of a control system 580 incorporating the LCD display unit 44, the air control board 512, the communication hub or network 508, and the algorithm control unit 526. The communication hub 508 which receives sensor data from the head zone sensor 68 and the seat zone sensor 70 is coupled to both the LCD display unit 44 and the algorithm control unit 526 through a first sensor data line 582 and a second sensor data line 584 respectively. As described with respect to FIG. 6, the algorithm control unit 526 includes sensory algorithms 574 and control algorithms 576. The algorithm control unit 526 includes a first output line 586 coupled to the LCD display unit 44 for transmitting patient position monitor status, a second control line 588 for communicating movement status, and a third control line 590 for communicating the status of the algorithm control unit. The algorithm control unit 526 includes a fourth output line 592 which transmits the zone pressure set points for each of the head, seat and foot zones to the air control board 512 to which the line 592 is coupled. The air control board 512, which includes the pressure sensors previously described, sends control pressure zone feedback signals through a line 594 back to the algorithm control unit 526.

A fifth control line 595 coupled to the algorithm control unit 526 and to the LCD display unit 44 transmits status information related to the pressure offsets being applied to the optimized pressures determined by the algorithm control unit 526. The control line 595, while illustrated as a separate control line may be included with the third control line 590 if desired. In addition to the status information related to the pressure offsets being applied to the optimized pressures, pressure setpoints of the head, seat, and foot zones, based on patient weight without being optimized, may be transmitted to the display unit 44.

The LCD display unit 44 through the user input interface device 524 also sends control signals to the algorithm control unit 526 through a control line 596 which includes signals such as various mode command signals as well as bed type command signals for adjusting the frame or deck of the bed. These signals include signals indicating the offset to be applied to the offset pressure when in the comfort control mode as well as signals inducting the selection of the comfort control mode and the manual mode.

As previously described in FIG. 6, the present invention includes sensory algorithms as well as control algorithms. The sensory algorithms are provided in firmware located within the multiplexer 508 and the algorithm control unit 526. Sensory algorithms include the following: bottom out detection, where a portion of the subject is supported by the bed frame as opposed to the surface, bed exit detection, sitting on the side of a bed detection, detection of a patient lying on the edge of the surface, detecting a lack of patient movement on the surface over a period of time, providing patient position monitoring by distinguishing between the following six positions left lying, left sitting, center lying, center sitting, right lying, right sitting, and measuring patient weight within plus or minus 20% within the bed and the flat position. The control system algorithms which are located in the control system algorithm firmware 576 optimize pressure reduction by dynamic load distribution adjustment of the surface air bladders of the mattress 10 located above the head sensor pad 68 and the seats sensor pad 70.

Figure 8:
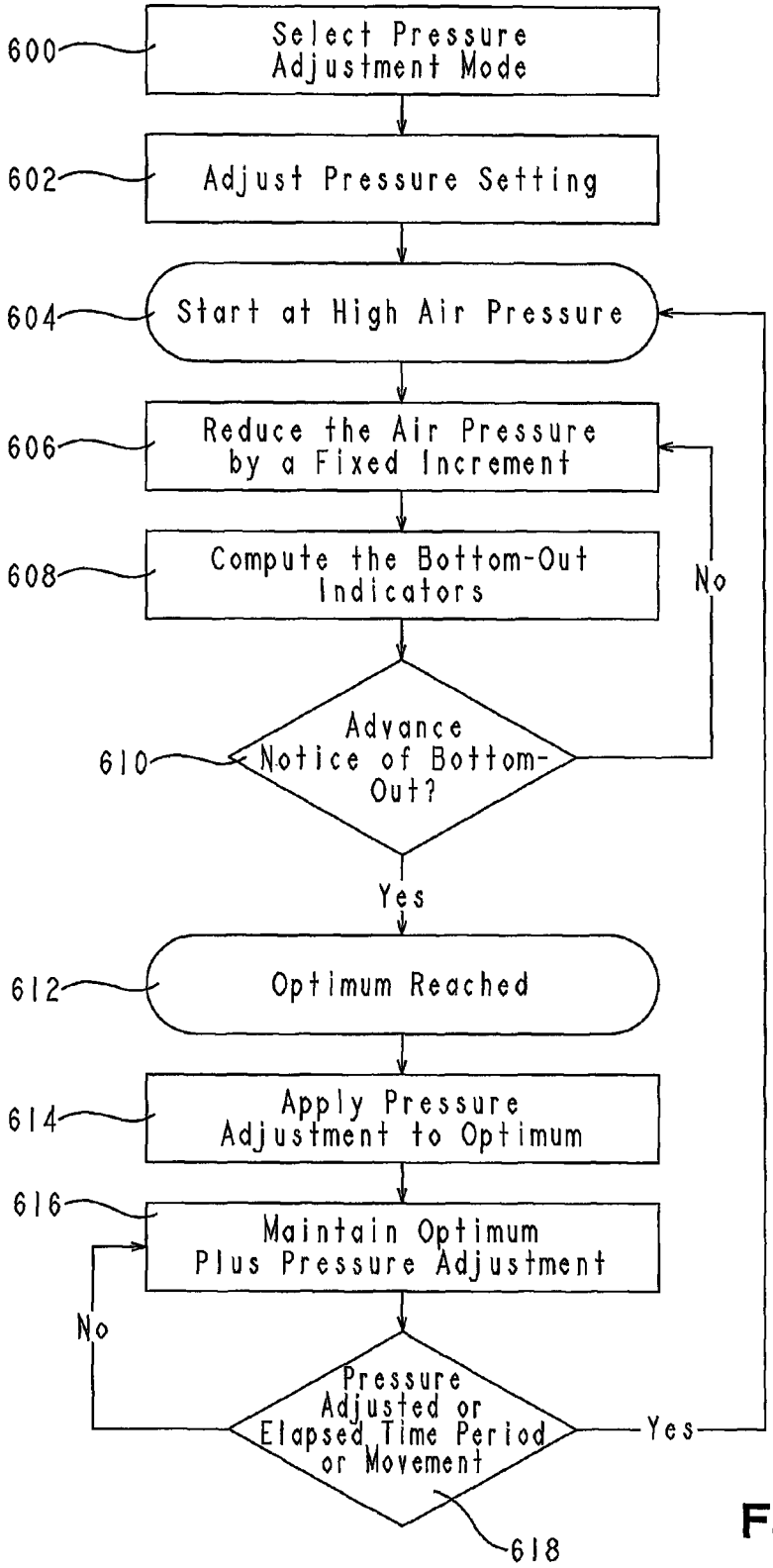
FIG. 8 is a flow diagram illustrating one embodiment of the present invention for applying an offset to an optimized pressure.

FIG. 8 is a flow chart illustrating a method of determining a pressure for the patient support of the present invention in a pressure adjustment mode. This mode is also called firmness override mode or comfort control mode. The present invention provides for pressure relief within the air bladders by monitoring the air pressure in the bladders and controlling that air pressure through the detection of the force or pressure transmitted through the air bladders to the sensors located therebeneath. The present invention includes an offset pressure which controls the adjustment of pressure around an optimized air pressure which is determined according to the described method. Based on the assumption that the optimum air pressure is the pressure just prior to bottoming out, the bottoming out condition may be used as a signal that the optimum pressure has been reached. While the optimum pressure may be considered to be the pressure just prior to bottoming out, on occasion a patient may desire to have the pressure adjusted to a value different than the value of the determined optimized pressure. The optimum pressure may not be preferred by an individual patient or caregiver and consequently the present invention may be used to adjust the air pressure above or below the optimum air pressure.

As illustrated in FIG. 8, at step 600, a comfort adjust or pressure adjustment mode is selected by the caregiver. Selection of this mode is further described with the user interface for the discussion of FIGS. 10-15 to be described later. Once the manual pressure adjustment mode has been selected, the pressure setting is adjusted. In one embodiment of the present invention, the head zone bladders, seat zone bladders, and foot zone bladders may be adjusted. The adjustment of the pressure setting for each of these zones is an incremental or decremental pressure offset around a determined optimized pressure. Once the amount of pressure adjustment or offset has been selected by the caregiver at step 602, an optimal pressure is determined.

To determine the optimal pressure, the bladders are initially filled to a high pressure at step 604 of FIG. 8. Initially the bladders may be filled to 25 inches of water. Once a patient is on the mattress, the mass of the patient is calculated according to a mass or weight algorithm as is known by those skilled in the art. Once the mass of the patient has been calculated, the pressure within the bladders is lowered by fixed increments at step 606 of FIG. 8. As the pressure is lowered, the sensors of the sensor pads 68 and 70 are accessed according to the sequences previously shown in FIG. 5. The data or information provided by 22 of the sensors within each of the sensor groups is read or provided approximately every one quarter of a second. Consequently, the information from the first, second, third and fourth sensor groups 550, 552, 554, and 556 are provided approximately every one second. This information is used to compute the bottoming out indicators at step 608. The bottoming out indicators are derived from the pressure distribution data derived from the sensors from each of the sensor pads 68 and 70.

The bottom-out indicators are used to determine a bottoming-out trend. Such indicators may include:

(a) The sum of outputs of sensors over a "high pressure threshold." For this indicator, a threshold is set, and the amount by which the sensors exceed this threshold is accumulated. The high-pressure threshold may be fixed, or preferably, it may be computed from time to time in proportion to the average sensor output. It has been found that it is preferable to set the high-pressure threshold in the range of 1.2 to 3.0 times the average of all sensor outputs.

(b) The area not providing support, as measured by the number of sensors below a "support threshold". The "area not providing support" decreases when the support area increases. The support threshold may be fixed, or preferably, the support threshold may be computed from time to time in proportion to the average sensor output. It has been found that it is preferable to set the high-pressure threshold in the range of 0.1 to 0.7 times the average of all sensor outputs.

(c) The number of sensors over a high-pressure threshold. Similar to the indicator described in (a) above, a high-pressure threshold is set, and the number of sensors that exceed that high-pressure threshold is counted.

(d) The maximum output reported by any given sensor.

(e) The average value of the three sensors reporting the highest outputs.

(f) The standard deviation of all of the sensor outputs. This is calculated in accordance with the formula: standard deviation equals the square root of the sum of squared differences between the sensor output and the mean sensor output, divided by the number sensors minus one.

(g) The high-side deviation of sensor outputs. This indicator calculated in a similar manner to the standard deviation. In this case, however, only those sensor outputs that exceed the mean sensor output are used in the computation.

(h) The changes in the above indicators as a ratio to the change in bladder air pressure.

The pressure optimization algorithm may use a distributed standard deviation of the data to provide an indicator which corresponds to a pressure within each of the head and seat bladder sections. In another embodiment, only the seat bladder section is used to provide for the optimization algorithm and the head section bladder pressure is determined as a percentage of the seat bladder section pressure determined. As the distributed standard deviation trends toward a certain value, the air pressure is continually reduced at step 606 as long as the advance notice of bottoming out at decision step 610 is not indicated. If, however, the advance notice of bottoming out does occur as determined at decision step 610, then the preferred or optimum value of pressure is reached at step 612. Once the optimum pressure is reached at step 612, then the pressure adjustment or offset is applied to that optimum value at step 614. The adjust pressure algorithm then sends a signal to the air pressure controller or valves of the air control board 512 to maintain the pressure within the head, seat and/or foot zone. The pressure or forces transmitted through each of the zone bladders is continuously monitored and used to adjust the pressure within the bladders.

At step 616 of FIG. 8, the pressure is maintained in the comfort adjust mode by maintaining the optimum pressure determined plus the pressure adjustment offset which adjusts the optimum pressure above or below the determined optimum pressure. The pressure or forces transmitted through the zones are continuously monitored at this step. If, however, the pressure is adjusted through the user interface, or an elapsed time period has occurred over which no movement has taken place, or there is actual movement as determined at Step 618, then the system reinitializes itself and returns to step 604. At step 604, the algorithm pressurizes the bladder to a high air pressure and reduces that air pressure by a fixed increment to determine the trend toward bottoming out. As before, once the optimum pressure has been reached at step 612, the pressure adjustment above or below optimum is applied to the determined optimum pressure and is maintained at step 616. If there is no pressure adjustment by a caregiver or the elapsed time period has not occurred or if there is no movement, then the optimum pressure including the pressure adjustment offset is maintained at step 616.

Figure 9:
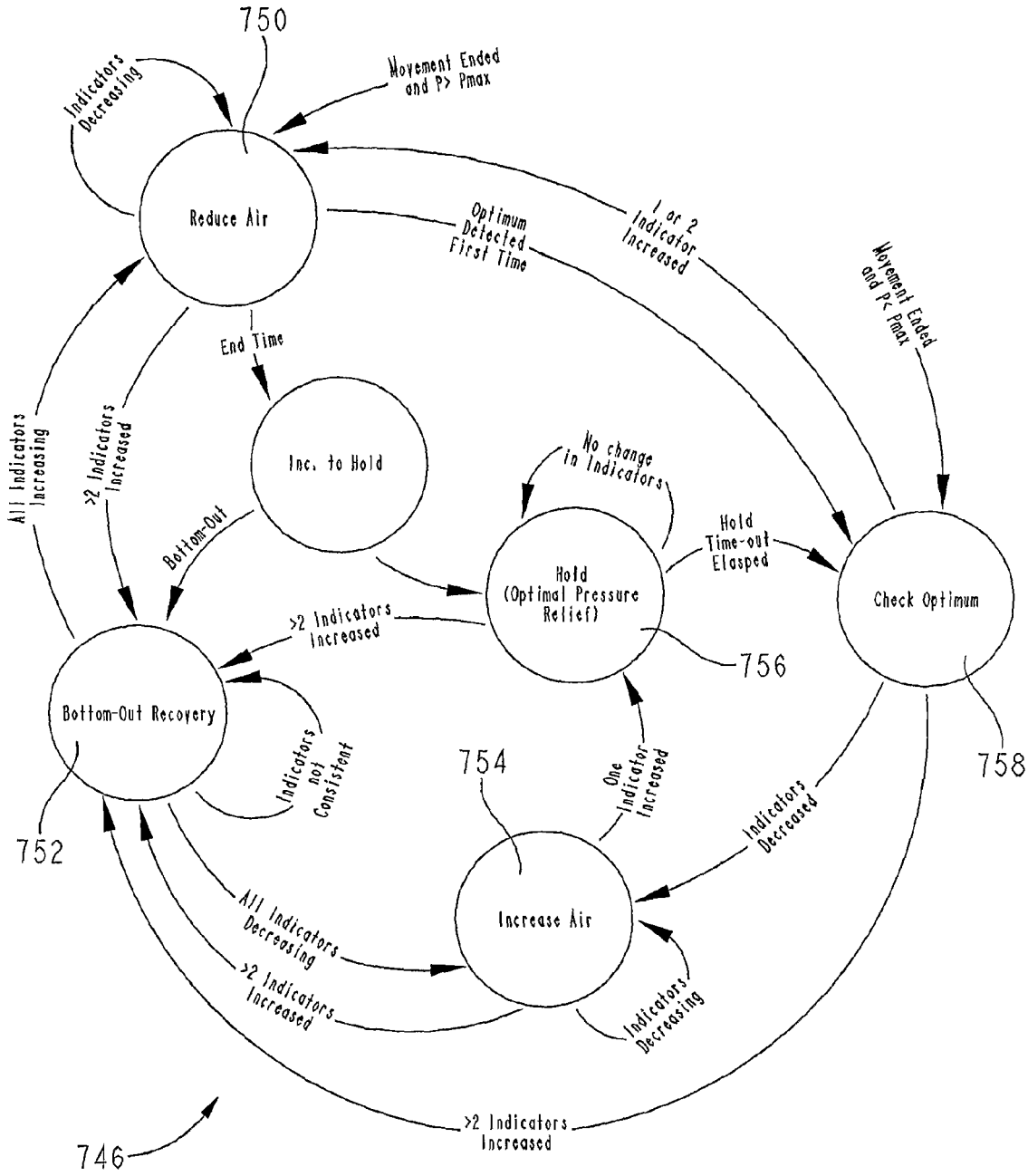
FIG. 9 illustrates the state machine diagram for a pressure relief control system of the present invention.

FIG. 9 illustrates a state transition diagram for a pressure relief state machine 746. As previously described, the bottoming-out indicators provide advance notice of bottoming-out. Based on the assumption that the optimum air pressure is the pressure just prior to bottoming-out, this advance notification is used as a signal that the optimum or preferred pressure has been reached. As previously described, air pressure is reduced in increments. After each increment the bottoming-out indicators may be computed. At the time that the bottoming-out indicators provide advance notice, then the air pressure maintained is that at that setting and the optimum or preferred pressure relief is achieved.

In the figure, the curved arrows indicate the allowable transitions between states. The conditions that precipitate a transition from one state to another are labeled on each arrow. In some cases, the reasons are based on a count of the number of indicators meeting a certain condition (eg. ">2 indicators decreasing"). It is to be understood that conditions may be replaced by comparing a single indicator (or weighted sum of indicators) against a suitable threshold.

If it is determined that the movement has ended and that P is greater than or equal to P max, then the air is reduced at a reduce air state 750. If it is determined that the indicators are decreasing, the system continues to reduce the air in the mattress bladders. If, however, it is determined that more than two indicators are increasing, the system enters a bottoming-out recovery state 752. The system remains in the bottoming-out recovery state if the indicators are not consistent. If, however, the indicators are increasing, then the system returns to the reduce air state 750. If, on the other hand, all indicators are decreasing, then the system enters an increase air state 754 where the air within the bladder is increased. The system remains in the increase air state 754 if all indicators are decreasing.

If more than two indicators increase, the system leaves the increase air state 754 and returns to the bottoming-out recovery state 752. If one indicator increases, then the system moves to the hold state 756 where the air pressure within the mattresses is maintained for the optimum or preferred pressure relief. If there are no changes to the indicators while in the hold state 756, the system remains in the optimal pressure mode. If, however, more than two indicators have increased while in the hold state 756, the system returns to the bottoming-out recovery state 752 as previously described. While in the hold state 756, a timer is set which enables the system to check for an optimum state at check optimum state 758 after the time out has elapsed. When in the check optimum state 758, if one or two indicators have increased, the system returns to the reduce air state 750 where the air in the bladders is reduced. If the optimum state is detected while in the reduced air state 750, the system moves to the check optimum state 758. A timer may also be set while in the reduce air state 750 whereupon at the end of the elapsed time the system returns to the hold pressure state 756.

When the bed is empty, the automatic control system is in the "Bed Empty" state. In this state, the control system sets the air pressure set-point to a value sufficient to fully inflate the air bladder.

It is known how to determine whether a patient has entered the bed (see for example, Lokhorst et al PCT international Publication WO 2004/006768) using an interface pressure sensor. Alternatively, other means, such as load cells in the legs of the bed frame or capacitive sensors or other types of bed occupant detection switches, may be employed to determine if a person occupies the bed. As soon as an occupant is detected, the automatic control system switches into the "valves closed" state. In this state, the automatic control system transmits instructions to the air pressure regulator to close off airflow in and out of the air bladder (essentially, to stop regulating the air pressure for the time being). When a fixed time period has elapsed, preferably about 5 to 30 seconds, the automatic control system switches into the "reduce air" state.

In the "reduce air" state, the automatic control system instructs the air regulator to reduce the air pressure by some increment. After a period of time, the indicators are computed. If the indicators have reduced, then the automatic control system remains in the "reduce air" state and initiates another decrement to the air pressure. If an indicator or two are found to have increased, then it means that the bottoming-out trend has started, and so the automatic control system switches to the "hold" state.

In the "hold" state, the automatic control system instructs the air regulator to maintain the air pressure at the value it was when the state was entered. Periodically, the indicators are computed. If there is no significant change in indicators, then the automatic control system remains in the "hold" state. If an indicator increases while in the "hold" state, it may be indicative of the occupant moving. In that case it is necessary to conduct a test to determine if the air pressure presently being maintained is optimal. This test is automatically conducted by switching to the "check optimum" state.

In the "check optimum" state, the automatic control system instructs the air pressure regulator to increment the air pressure by some interval. When the desired increase in air pressure has been achieved (or, alternatively, a reasonable length of time has elapsed), the indicators are computed. If the indicators decreased, it indicates that another increment in air pressure is required, so the system switches to the "increase air" state (which is subsequently described). As previously stated, the indicators were chosen so that minimum values are reached at or about the lowest air pressure prior to bottoming-out. Therefore, if the indicators decrease with increasing air pressure, then it indicates that the air pressure is still too low—further increasing the air pressure is likely to further reduce the indicators. If, on the other hand, the indicators generally increase after the increment in air pressure, then the opposite is true: the air pressure is now higher than optimum, and the system switches into the "reduce air" state.

In the "increase air" state, the automatic control system instructs the air regulator to increase the air pressure by some increment. After a period of time, the indicators are computed. If the indicators have reduced, then the automatic control system remains in the "increase air" state and initiates another increment to the air pressure. If an indicator or two are found to have increased, then it means that the bottoming-out trend has been reverted, and so the automatic control system switches to the "hold" state.

Figure 10:
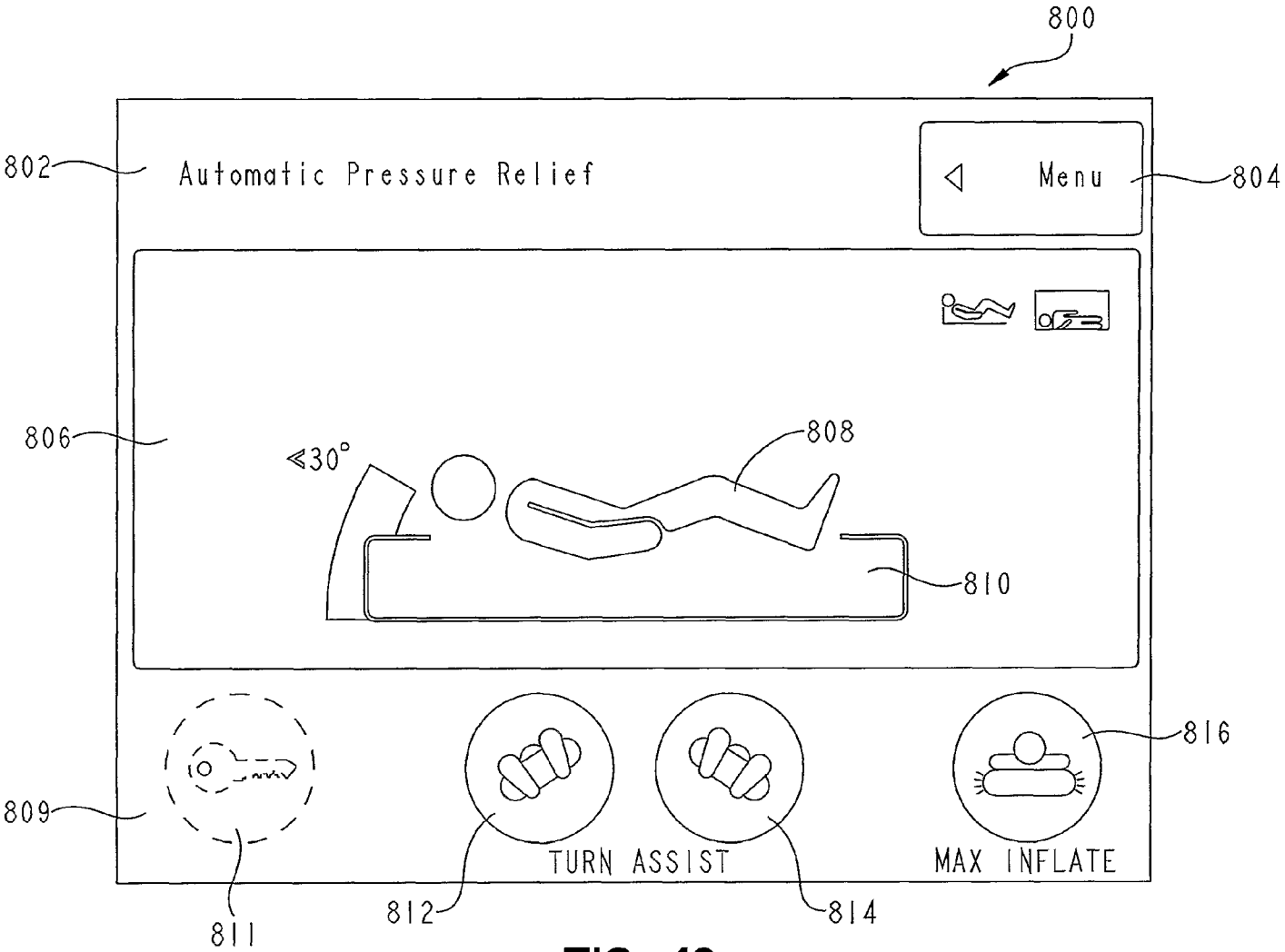
FIG. 10 is a screen display of the present invention in the automatic pressure relief mode including a graphical display of the sports surface as well as various input selectors.

FIG. 10 is a screen display 800 displayed on the user interface 44 when the patient support is in the automatic pressure relief or optimized pressure mode. This mode is the default mode when the mattress system is initially turned on. As illustrated, the screen display 800 includes a mode identifying area or portion 802 where the current mode is displayed. As illustrated in section 802, the mode currently being displayed is the automatic pressure relief mode. A menu button 804 is included to select various features of the present apparatus to be described herein. A middle portion 806 of the screen display 800 may be used to display the current status of the patient support. For instance, as illustrated, the head of bed is elevated at less than 30 degrees and a patient 808 is diagrammatically illustrated as laying on a surface 810. A bottom portion 809 illustrates a number of selectable user interface buttons or inputs, which may include touch screen buttons or electrical contact buttons. The included user interface selector buttons are a key button 811, a turn assist button which includes a left turn assist button 812 and a right turn assist button 814, and a maximum (max) inflate button 816.

Figure 11:
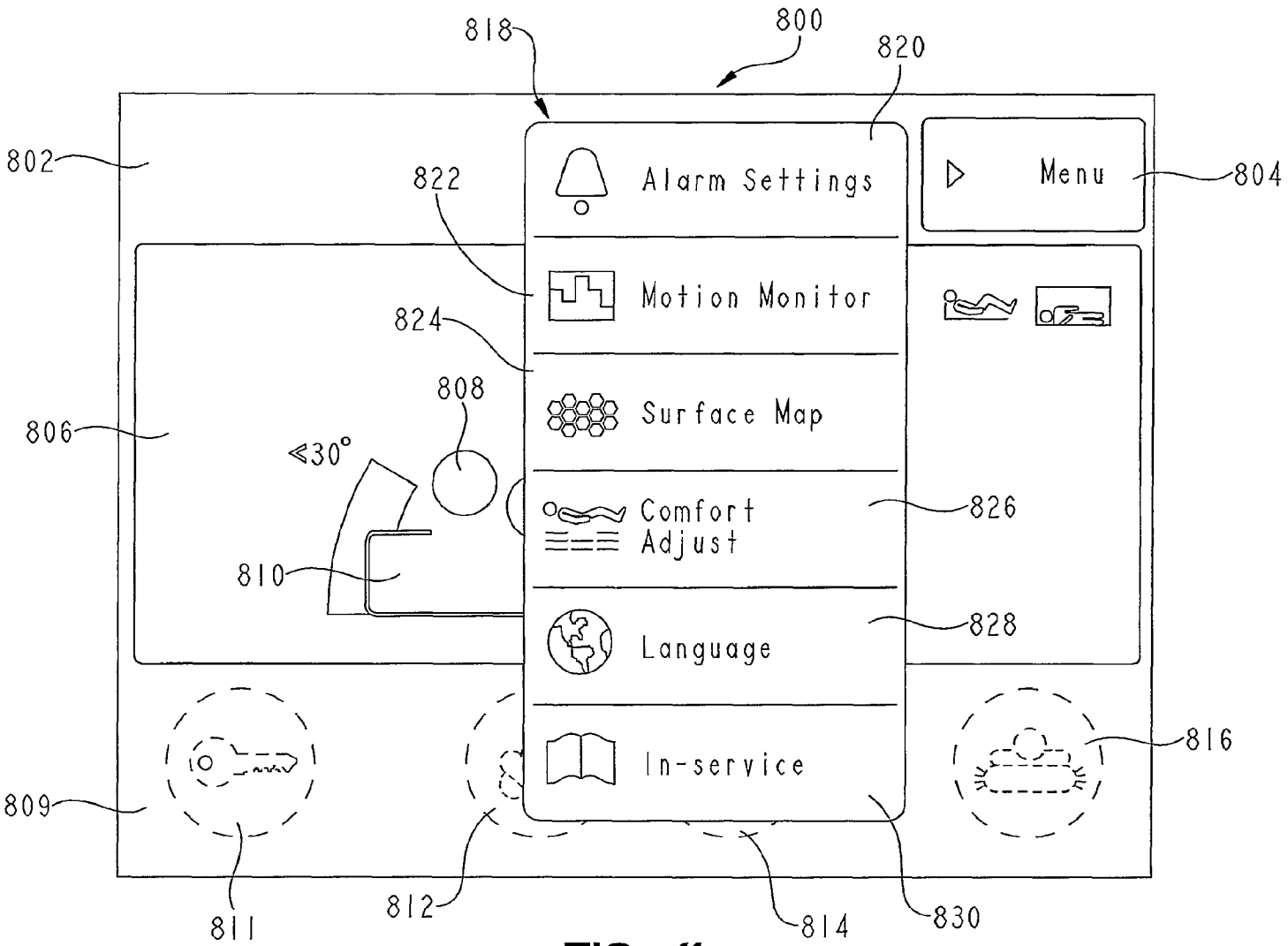
FIG. 11 is a screen display of a menu including various features that may be selected.

FIG. 11 illustrates the screen display 800 where the menu button 804 has been selected to display a pull down menu 818. The pull down menu 818 includes a number of selector buttons for choosing from a variety of functions. For instance, the pull down menu 818 includes a selector 820 for alarm settings, a selector 822 for selecting the motion monitor which has been described in U.S. patent application Ser. No. 11/119,635, entitled LACK OF PATIENT MOVEMENT MONITOR AND METHOD, a selector 824 for displaying a surface map, a selection 826 for selecting the comfort adjust mode of the present invention, a selector 828 for selecting from a variety of languages, and an in-service selector 830 which may be used by a technician or other personnel for setting features or for providing service to the device described herein.

Figure 12:
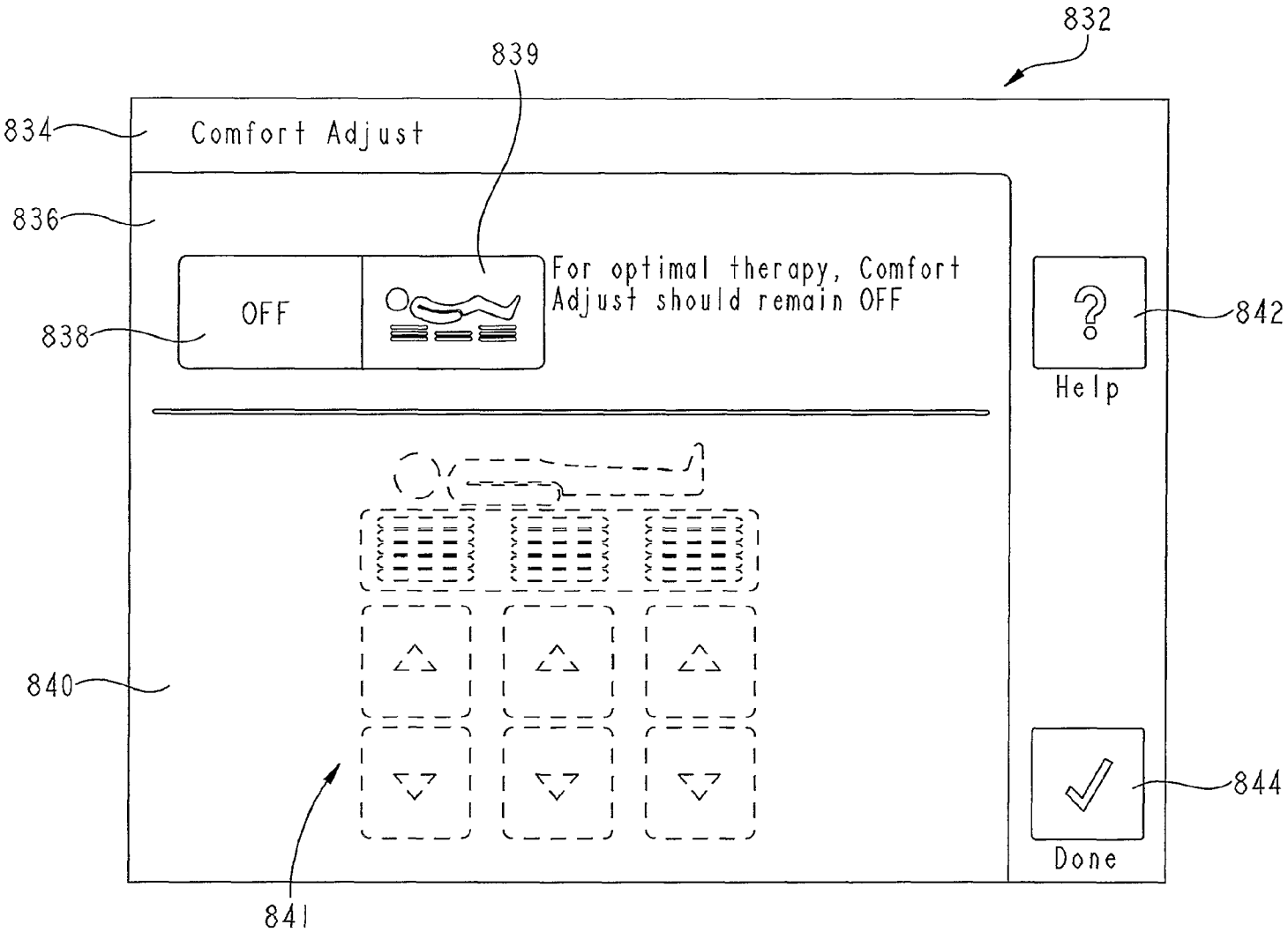
FIG. 12 is a screen display of the comfort adjust screen, also known as firmness override, for adjusting an offset pressure in the head, seat, and foot zones.
Figure 13:
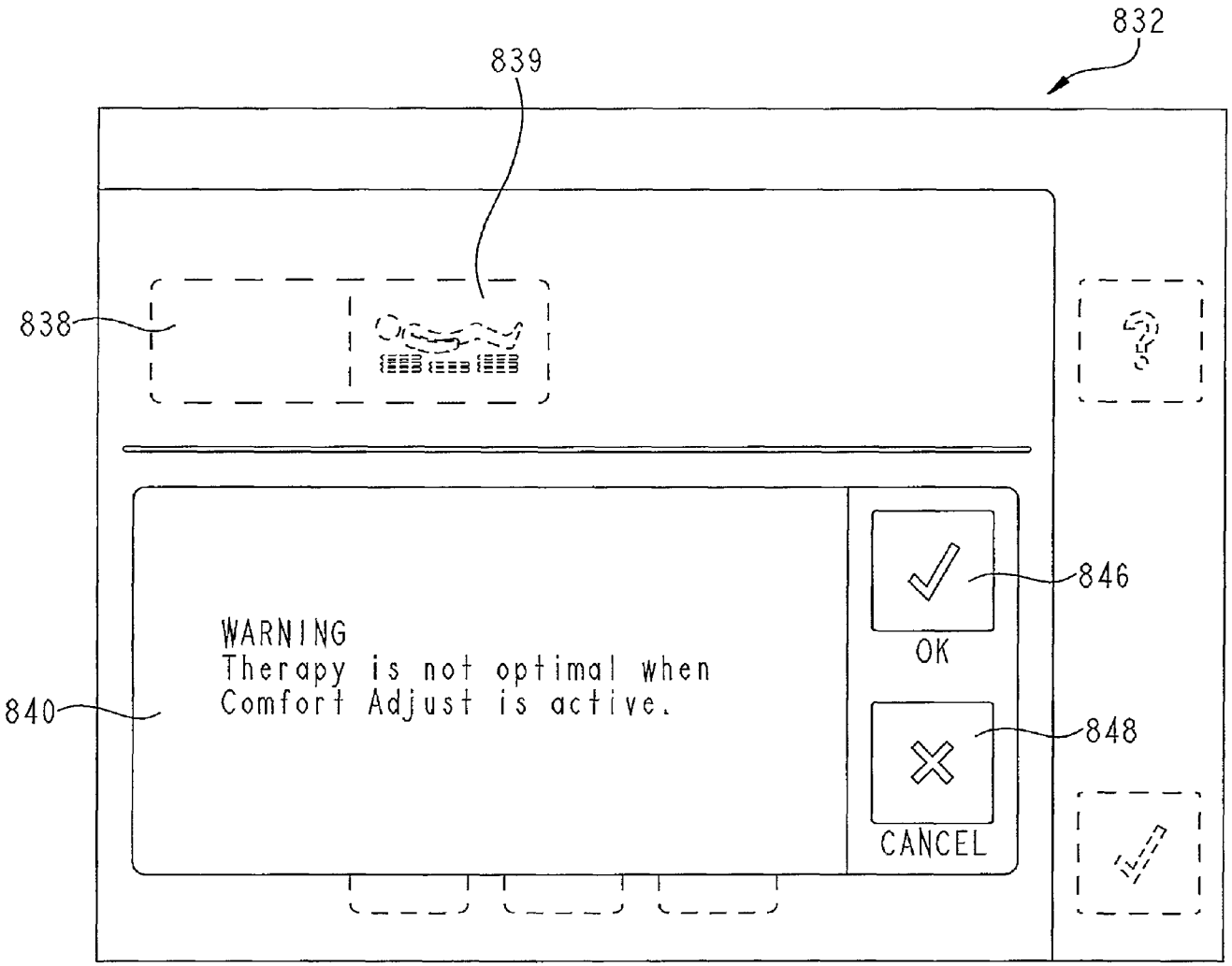
FIG. 13 illustrates the screen display of FIG. 12 when the on button is selected through the off button and a warning screen is shown to indicate that therapy is not optimal when the comfort adjust is active.

Once the comfort adjust selector 826 has been selected, a user interface screen 832 of FIG. 12 is displayed. In a mode identifying portion or area 834 of the screen 832, the selected mode of comfort adjust is displayed. In a status section 836, an off button 838, to turn off comfort adjust mode, and a comfort adjust button 839, which includes a schematic drawing of a patient on a surface, are included. The language "For optimal therapy, comfort adjust should remain off" is displayed. When the screen 832 is initially displayed as illustrated in FIG. 10, the user has the opportunity to select whether or not the optimum therapy should remain in the on state and the comfort adjust should remain in the off state. In this way, the caregiver is given the opportunity to verify that the comfort adjust is to be the selected mode. As illustrated in FIG. 12, the portion 840 indicates that the comfort adjust has not yet been selected since the user interface selector buttons 841 are illustrated as being in dotted outline. In one embodiment, display 841 of the portion 840 includes a lighter or phantom image where the caregiver may not select the various buttons displayed which are lightly shown. When selectable, the displayed images are shown in a darker or full image. In addition, the screen display 832 includes a help button 842 for providing information to a caregiver when help is needed as well as a done button 844 which may be selected if the caregiver decides that the comfort adjust mode or function is not preferred at this time.

If the caregiver decides that the comfort adjust function is desired, then the caregiver selects the comfort adjust button 839 of FIG. 12. When selected, a warning screen 840 (see FIG. 13) appears, indicating that the therapy is not optimized or is not in an optimal condition when the comfort adjust is active. If the caregiver wishes to continue with the comfort adjust function, the caregiver selects the OK button 846 to enter the comfort adjust function. If, however, the caregiver decides that the comfort adjust therapy is not desired, the caregiver selects the cancel button whereupon the screen display returns to the screen display 800 of FIG. 10.

Figure 14:
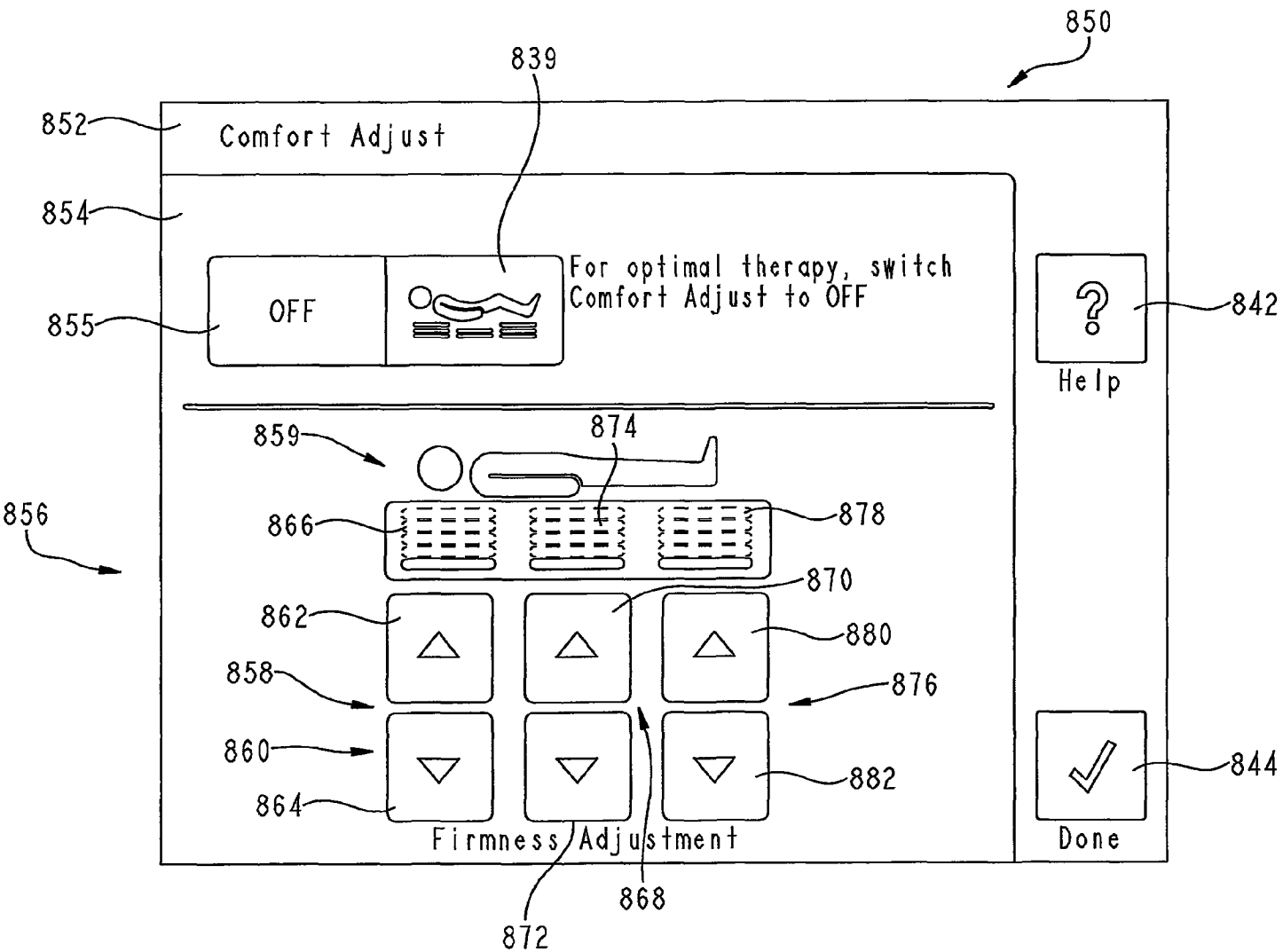
FIG. 14 is a screen display of comfort adjust once the comfort adjust function has been selected including adjustment selectors to adjust the firmness around the optimum in each of the head, seat and foot zones.

FIG. 14 illustrates a comfort adjust screen display 850 of the present invention. The screen display 850 includes a mode identifying portion or area 852 indicating that the comfort adjust function has been selected. While in the comfort adjust function, a portion 854 indicates that the mattress is currently in the comfort adjust mode and not in the optimal therapy mode. A button 855 is provided for turning the comfort adjust off. A bottom portion 856 of the screen display 850 includes a selector portion 858 as well as patient interface portion 859. The portion 858 includes a plurality of adjustment buttons for adjusting an offset pressure around the optimum pressure as previously described. For instance, in a head portion of the mattress, an up/down selector 860 includes an up button 862 and a down button 864 for adjusting the offset to a head portion 866 of the mattress. A seat adjustment portion 868 includes an up button 870 and a down button 872. As illustrated, the seat portion pressure may be adjusted with the up and down buttons to select the offset from optimal for the seat portion 874. A foot adjustment selector 876 adjusts a seat portion 878 which includes an up button 880 and a down button 882. In this way, a caregiver may adjust each of the sections to a preferred pressure according to the patient's or caregiver's wishes. The screen display 850 also includes the previously described help button 842 and the done button 844.

Figure 15:
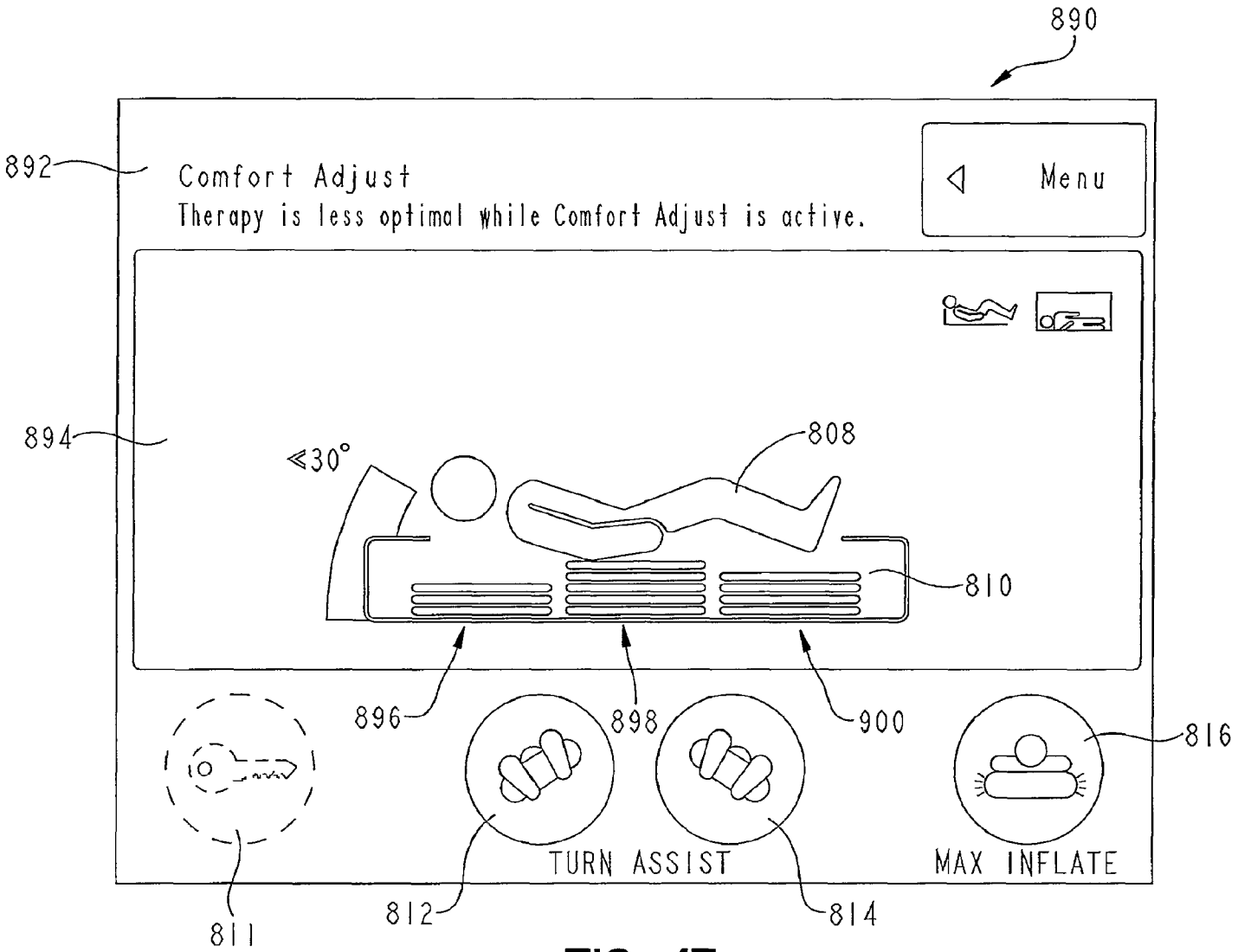
FIG. 15 is a screen display of the comfort adjust screen when the comfort adjust is active illustrating the pressures within each of the head, foot and seat zones.

FIG. 15 illustrates a screen display 890 of the present invention once the comfort adjust mode has been selected and the offset pressures selected. In this mode, a mode identifying portion 892 indicates that the support system is in the comfort adjust mode and that the therapy is less than optimal while the comfort adjust is active. A portion 894 of the display 890 illustrates the patient 808 lying upon the support surface 810. While in the comfort adjust mode, the support surface 818 indicates the amount of pressure offset in a head zone 896, a seat zone 898 and a foot zone 900. Any zone may be adjusted. It is within the scope of the present invention to provide for the adjustment of any one zone, any two zones, or all three zones. In addition, it is within the scope of the present invention to provide for an incremental (positive) offset only, a decremental (negative) offset only, or both offsets, or any combination thereof. Each of the zones 896, 898 and 900 include one or more illustrated horizontal bars to provide an indication of the amount of change which has been made to the automatic pressure relief mode. In one embodiment, the full range of adjustment or offset is 2 inches of water. Consequently with 4 bars of adjustment, each single bar provides an adjustment of one-half inch of water. It is within the scope of the present invention to include other ranges of offset and other numbers of bars. The amount of adjustment corresponding to a single bar may be other than one-half inch of water. The screen display 890 also includes the previously described key button 810, left turn assist button 812, right turn assist button 814 and max inflate button 816. Consequently, while in the comfort adjust mode, the turn assist functions are available as well as the maximum inflate function.

Figure 16:
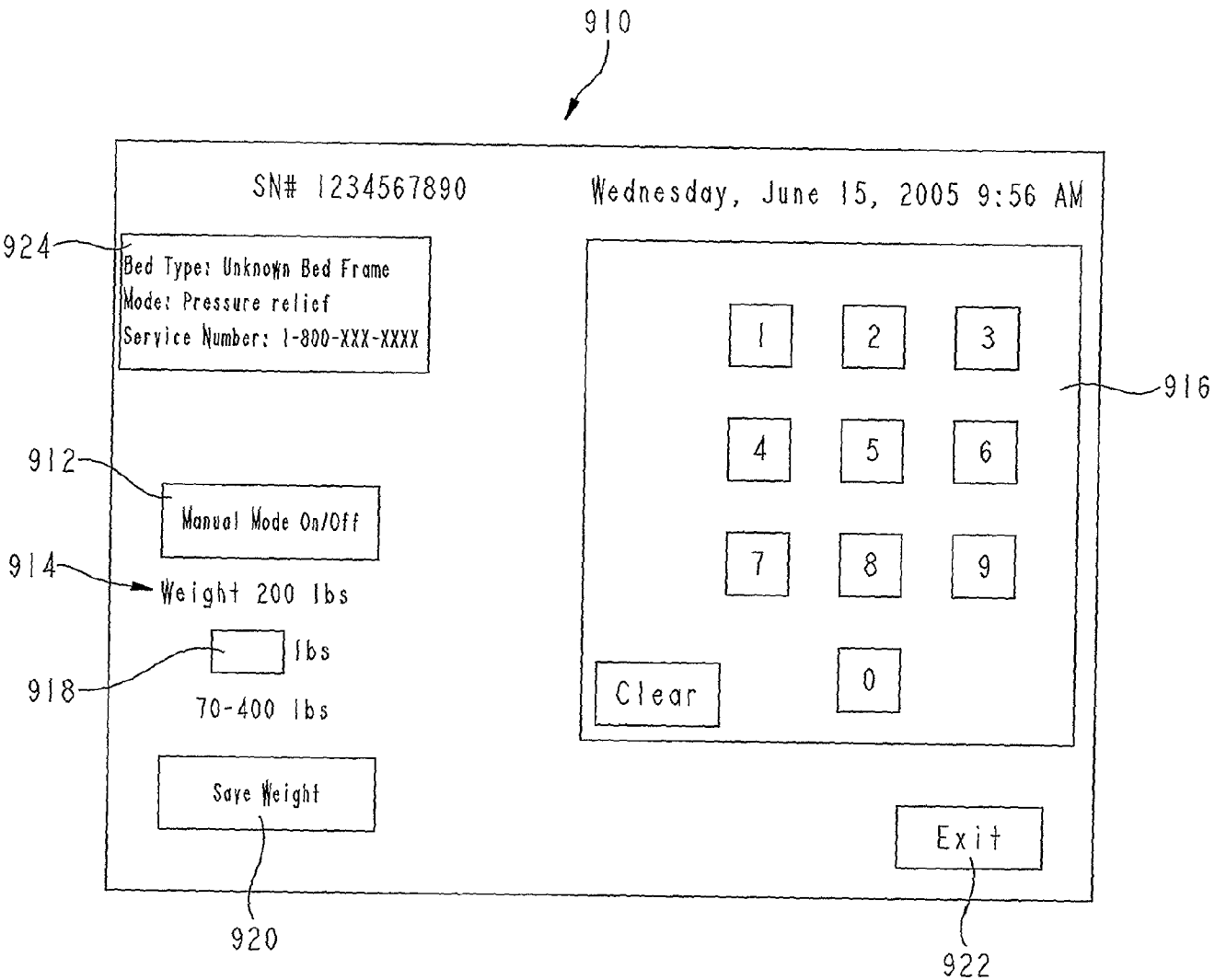
FIG. 16 is a screen display of a service mode screen for selecting a manual mode where patient weight is entered to adjust mattress pressure.

Referring now to FIG. 16, a manual mode display screen 910 is displayed for selecting a manual mode. To access the manual mode display screen 910, the menu button 804 of FIG. 11 is selected to display the pull down menu 818. By selecting the in-service button 830, the manual mode may be selected through another pull-down menu (not shown). Typically the in-service features are only available to a technician.

In the manual mode, the service technician, or other authorized person, may select the manual mode by selecting the manual mode on/off button 912. If the manual mode is selected, the automatic pressure relief function as well as the comfort adjust functions are turned off, such that the mattress pressures are determined according to patient weight only. Suitable mattress pressure corresponding to patient weight are stored in a look-up table as is understood by those skilled in the art. The system, when the manual mode defaults to a patient weight of 200 lbs., is illustrated at weight line 914. The technician may, however, select another patient weight, for instance, from 70 to 400 pounds. Other weights are within the scope of the invention. To select a patient weight, the technician selects a weight by entering the appropriate value with a keypad 916 which includes numeric buttons and a clear button. Once the weight is entered, the selected weight appears in the weight display 918. If the technician is satisfied with the entered weight, it may be saved by pressing the save weight button 920. Once weight is entered, the system may generate the appropriate pressure(s) according to the look-up table. Once the weight is entered, an exit button 922 may be pressed to return to the main service screen. The display 910 also includes the mattress serial number, the current date, and an identifying portion 924 to indicate bed type, mattress mode, and a service phone number. The pressures which have been set based on the entered weight are maintained until changed by the technician or other individual.

Figure 17:
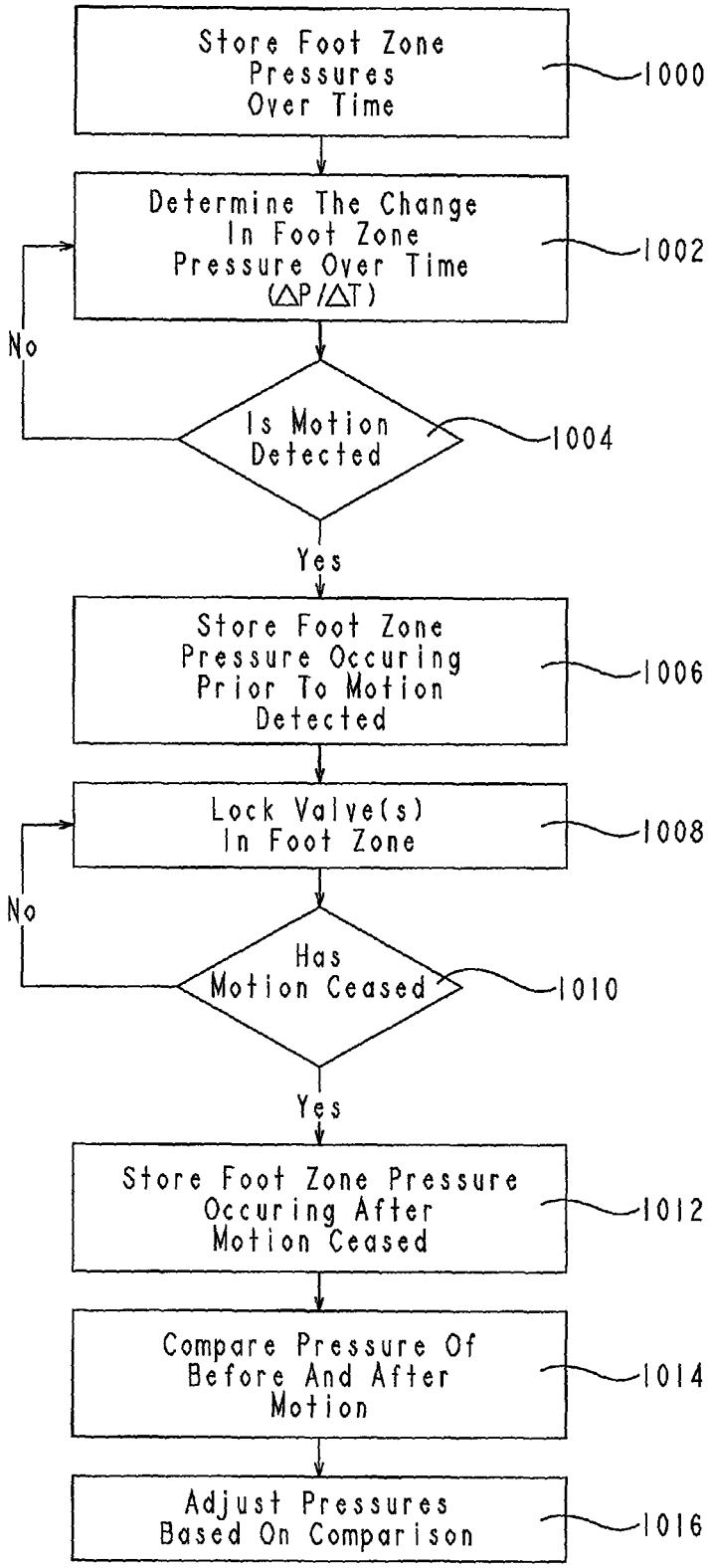
FIG. 17 is a flow diagram illustrating one embodiment of the present invention for determining the presence or absence of a patient located in the foot zone.

FIG. 17 is a flow diagram illustrating one embodiment of the present invention for determining the presence or absence of a patient located on the foot zone bladders in the foot zone. Whenever a patient is either sitting up with their legs on the bed or is sitting on the side of the bed with their legs hanging over the edge of the bed, the interface between the patient and the mattress should be stable and supportive. To provide adequate support, it is preferred that the mattress permits the patient to sit without excess movement of the mattress underneath. The position of the patient should be sufficiently stable to evenly support the patient so that tipping is prevented. It is preferred that even support occurs whether the patient is sitting entirely in the foot zone or if the patient is straddling the boundary of the foot zone and the seat zone.

In order to provide adequate support and stability for the patient, the algorithms, embodied in the software or firmware of the present invention, detect the presence or absence of the patient in the head, seat, or foot zone, and the adjusts the air pressures accordingly. Patient location may be determined by the sensor pads, as described herein, or by the air pressure of the foot zone determined by the pressure valve/transducer coupled to the foot zone bladder.

The flow diagram of FIG. 17 will be described with respect to controlling the pressure of the foot zone bladders. It is however within the scope of the present invention to control the pressure in the head zone bladders and the seat zone bladders as well. As illustrated at step 1000 of FIG. 17, the foot zone pressure is monitored by the pressure transducer and is stored over time in a memory device or buffer of the control system. This pressure value is continually updated and past values are stored for use in the algorithm. At step 1002, the change in pressure is determined over a predetermined period of time, for instance, a period of 5 seconds. Other periods or time are within the scope of the present invention. The change in pressure over the change in time is denoted as $\Delta P/\Delta T$. The $\Delta P/\Delta T$ is compared to two predetermined values, the result of which indicates that motion has occurred. For instance, if $\Delta P/\Delta T$ is greater than a first predetermined value or if $\Delta P/\Delta T$ is less than a second predetermined value, then motion is detected at step 1004 of FIG. 17. An increase in pressure resulting from a patient ingress would provide a positive value of $\Delta P/\Delta T$ and if this value is greater than the first predetermined value, then motion is detected at step 1004. A decrease in pressure resulting from a patient egress would provide a negative value of $\Delta P/\Delta T$ and if this value is less than the second predetermined value, then motion is also detected at step 1004 If, however, motion is not detected, then the algorithm continues to calculate $\Delta P/\Delta T$.

If motion is detected, then at step 1006, the foot zone pressure occurring prior to the detected motion is identified and is stored for later use. Once this pressure value is stored, the valves supplying air to the foot zone are locked in a closed position at step 1008, thereby substantially preventing the foot zone bladders from being controlled to a different pressure. Once the valves are locked, the algorithm determines whether there is stability or little change to the foot zone pressure. This determination is made by calculating the change in pressure to the foot zone over a period of time. If for instance, the change is less than one-half inch of water over a period of 5 seconds, then the algorithm determines that motion has ceased at step 1010. If the pressure has not stabilized, then the valves remain locked at step 1008. If, however, the motion has ceased, the foot zone pressure occurring after the motion has ceased is stored at step 1012.

Once the pressure after motion has stopped, the pressure value is stored, at step 1014. This value of pressure is compared to the previously stored value of pressure which was determined prior to the motion being detected. Based upon this comparison, the pressures are set in the foot zone and the seat zone at step 1016.

The pressures set in the foot zone and the seat zone at step 1016, are based on a determination of whether the pressure in the foot zone went up or down when compared to the previously stored value of the foot zone pressure occurring prior to the detected motion. If the pressure increased by a predetermined amount, for instance 5 inches of water, then the patient is found to be sitting or partially sitting in the foot zone. If, however, the air pressure decreased by a predetermined amount, the patient is found to be no longer sitting in the foot zone.

Once ingress is determined, i.e. the pressure increased, and it is determined that the seat zone pressure is less than eighty percent of the foot zone pressure, then the seat zone pressure is set to eighty percent of the foot zone pressure. If, however, the seat zone pressure is not less than eighty percent of the foot zone pressure, the foot zone pressure is set to one-hundred twenty-five percent of the seat zone pressure.

If egress occurs, i.e. the pressure has decreased, then the bladders are set to fixed predetermined pressures. For instance, the seat zone pressure can be set to twenty-five inches of water and the foot zone pressure can be set to thirty inches of water.

While this invention has been described with specific embodiments thereof, alternatives, modifications and variations may be apparent to those skilled in the art. For instance, evaluation of the change in head and seat air pressures could also be employed for assisting in the determination of the location of a patient. Accordingly, it is intended to embrace all such alternatives, modifications and variations that fall within the spirit and broad scope of this appended claims.

The invention claimed is:

1. A pressure adjustable mattress system to support a patient, comprising:

a pressure adjustable mattress;

a controller coupled to the pressure adjustable mattress to control the mattress in an automatic pressure relief mode and in a user adjustable mode, by, without leaving the automatic pressure relief mode:

computing an optimum pressure, controlling the pressure in the pressure adjustable mattress to the optimum pressure, receiving a user-specified pressure adjustment at a user interface device, wherein the user-specified pressure adjustment is specified relative to the computed optimum pressure, modifying the computed optimum pressure with the user-specified pressure adjustment, and controlling the pressure in the pressure adjustable mattress to maintain the modified optimum pressure; and a user interface, coupled to the controller, the user interface including a selectable input to enable a user to control pressure adjustment of the pressure adjustable mattress in the automatic pressure relief mode and the user adjustable mode.

2. The pressure adjustable mattress system of claim 1, wherein the pressure adjustable mattress includes a sensor, the sensor generating a pressure signal responsive to a pressure applied thereto, the sensor being operatively coupled to the controller.

3. The pressure adjustable mattress system of claim 2, wherein the pressure adjustable mattress includes a first portion including a plurality of upright cylindrical bladders.

4. The pressure adjustable mattress system of claim 3, further comprising a plurality of sensors wherein each of the plurality of sensors subtends at least one of the plurality of upright cylindrical bladders.

5. The pressure adjustable mattress system of claim 4, wherein each of the plurality of sensors comprises a light responsive sensor disposed in a compressible medium.

6. The pressure adjustable mattress system of claim 4, wherein the pressure adjustable mattress includes a second portion having a plurality of upright cylindrical bladders, the second portion located adjacent the first portion to support an upper portion of the patient, and the second portion to support a middle portion of the patient.

7. The pressure adjustable mattress system of claim 6, wherein each of the plurality of upright cylindrical bladders of the second portion include a height greater than the width.

8. The pressure adjustable mattress system of claim 6, wherein the controller includes a processing device, operatively coupled to the plurality of sensors, the processing device including first executable instructions responsive to each of the sensors generating a pressure signal and generating a control signal to adjust the pressure of the pressure adjustable mattress.

9. The pressure adjustable mattress system of claim 8, wherein the user interface includes a first input coupled to the controller and a second input coupled to the controller, the first input and second input to enable a user to adjust the pressure within the first portion and the second portion respectively.

10. The pressure adjustable mattress system of claim 9, wherein the pressure adjustable mattress includes a third portion to support a lower portion of the patient.

11. The pressure adjustable mattress system of claim 10, wherein the user interface includes a third input to adjust the pressure within the third portion.

12. The pressure adjustable mattress system of claim 11, wherein the plurality of sensors subtends the first portion and the second portion.

13. The pressure adjustable mattress system of claim 12, wherein the pressure of the third portion is selected to be a percentage of the pressure of the second portion.

14. The pressure adjustable mattress system of claim 13, wherein the user interface includes a warning screen, the warning screen to provide a notice to the user indicating a change to the automatic pressure mode if an OK button is selected by the user.

15. The pressure adjustable mattress system of claim 14, wherein the user interface includes a current setting screen to display information, to indicate the selected pressures in each of the first portion, the second portion and the third portion.

16. A method for adjusting the pressure in a pressure adjustable mattress system including a controller, a user interface to receive a user input comprising a pressure adjustment, and a mattress to support a person, comprising the steps of, when the pressure adjustable mattress is in an automatic pressure relief mode and without leaving the automatic pressure relief mode:

automatically determining a first pressure for the pressure adjustable mattress when the mattress is supporting the person, wherein the first pressure specifies a pressure value just prior to a bottoming-out condition; and adjusting the first pressure to a second pressure, different than the first pressure and based on the pressure adjustment, in response to the controller receiving the user input, wherein the adjustment is specified relative to the optimum pressure.

17. The method of claim 16, wherein the first pressure is an optimized pressure determined according to a bottoming-out condition.

18. The method of claim 16, wherein the second pressure is a pressure greater than the first pressure.

19. The method of claim 16, wherein the second pressure is a pressure less than the first pressure.

20. The method of claim 16, further comprising the step of maintaining the second pressure until the occurrence of an event.

21. The method of claim 20, wherein the occurrence of an event includes movement of the person on the mattress.

22. The method of claim 21, wherein the occurrence of an event includes an elapsed period of time.

23. The method of claim 20, further comprising the step of automatically determining a third pressure upon the occurrence of the event, the third pressure being an optimized pressure determined according to a bottoming-out condition.

24. The method of claim 23, further comprising adjusting the third pressure to fourth pressure, different than the third pressure, in response to the controller receiving the user input.

25. The system of claim 1, wherein the mattress is pressurizable and includes a sensor;

the controller includes at least one algorithm to adjust pressure in the mattress, the at least one algorithm includes automatic pressure adjustment and manual pressure adjustment; and the mattress is coupled to the controller.

26. The system of claim 25, wherein the user interface includes an input to turn off the automatic pressure adjustment algorithm and to allow selection of the manual pressure adjustment algorithm.

27. The system of claim 26, wherein the user interface includes an input to provide for the input of the patient's weight.

28. The system of claim 27, wherein the sensor includes a plurality of light responsive sensors disposed in a compressible medium.

29. The system of claim 1, wherein the controller includes a memory device and the mattress includes a first zone bladder having pressure, the controller being configured to:

store pressures of the first zone bladder in the memory;

detect whether motion has occurred based on changes to the stored pressures of the first zone bladder; and adjust the pressure of the first zone bladder if motion has occurred.

30. The system of claim 29, wherein the first zone is a foot zone.

* * * * *